US008019245B2

(12) United States Patent
Kushida

(10) Patent No.: US 8,019,245 B2
(45) Date of Patent: Sep. 13, 2011

(54) IMAGE FORMING DEVICE, AND METHOD AND COMPUTER READABLE MEDIUM THEREFOR

(75) Inventor: Tsuyoshi Kushida, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 338 days.

(21) Appl. No.: 12/241,449

(22) Filed: Sep. 30, 2008

(65) Prior Publication Data

US 2009/0087760 A1 Apr. 2, 2009

(30) Foreign Application Priority Data

Oct. 2, 2007 (JP) ..... 2007-258859

(51) Int. Cl.
*G03G 15/00* (2006.01)

(52) U.S. Cl. ..... 399/49; 399/51; 399/72

(58) Field of Classification Search ..... 399/49, 399/51, 72
See application file for complete search history.

(56) References Cited

U.S. PATENT DOCUMENTS

| | | | |
|---|---|---|---|
| 5,452,073 | A | 9/1995 | Kataoka |
| 5,600,404 | A | 2/1997 | Ando et al. |
| 6,330,404 | B1 | 12/2001 | Munenaka et al. |
| 6,418,295 | B1 | 7/2002 | Sato |

FOREIGN PATENT DOCUMENTS

| | | | |
|---|---|---|---|
| JP | 08-118737 | | 5/1996 |
| JP | 2000-194176 | | 7/2000 |
| JP | 2000-356875 | | 12/2000 |
| JP | 2001-034027 | A | 2/2001 |
| JP | 2001-066868 | A | 3/2001 |
| JP | 2005-148636 | A | 6/2005 |
| JP | 2005-202284 | | 7/2005 |
| JP | 2007-233193 | A | 9/2007 |

OTHER PUBLICATIONS

JP Office Action dtd Sep. 8, 2009, JP Appln. 2007-258859, English translation.
Extended EP Search Report and Search Opinion dtd May 17, 2010, EP Appln. 08015637.5.
[Corrected] CN Office Action dtd Feb. 22, 2011, CN Appln. No. 200810168880.8, English Translation.

*Primary Examiner* — Ryan D Walsh
(74) *Attorney, Agent, or Firm* — Banner & Witcoff, Ltd.

(57) ABSTRACT

An image forming device includes an image forming unit forming an image on a sheet with an image forming property, a pattern forming unit forming a pattern on an object, a detection value determining unit determining a first detection value representing the image forming property of the image forming unit through detecting the pattern formed on the object by the pattern forming unit, a storage unit storing thereon the first detection value determined by the detection value determining unit, a correction value determining unit determining a correction value for correcting the image forming property with the first detection value stored on the storage unit and a second detection value that has previously stored on the storage unit, and a control unit controlling the image forming unit to form the image with the image forming property corrected based upon the correction value determined by the correction value determining unit.

12 Claims, 19 Drawing Sheets

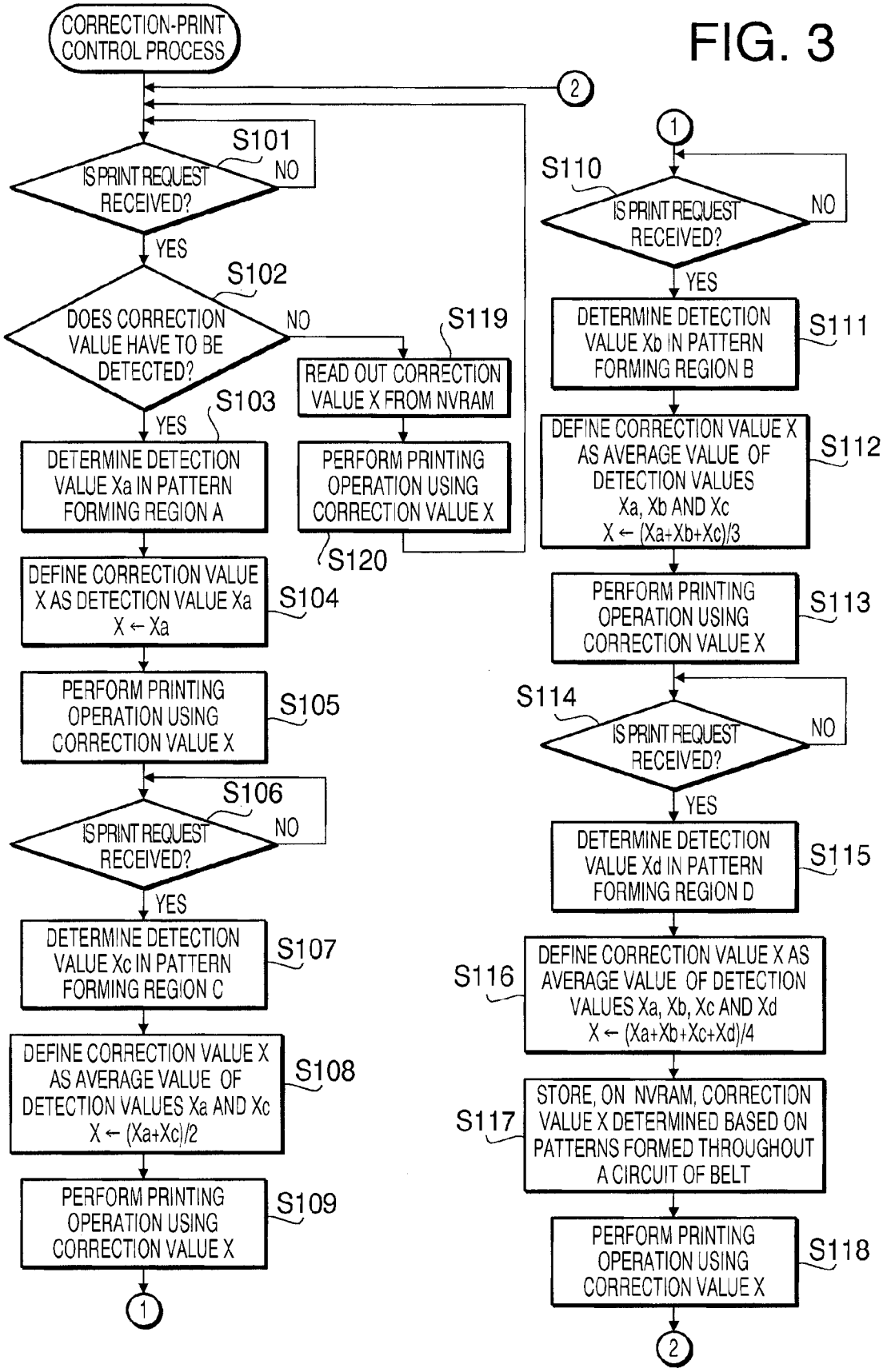
FIG. 3
CORRECTION-PRINT CONTROL PROCESS
S101
IS PRINT REQUEST RECEIVED?
NO
YES
S102
DOES CORRECTION VALUE HAVE TO BE DETECTED?
NO
S119
READ OUT CORRECTION VALUE X FROM NVRAM
PERFORM PRINTING OPERATION USING CORRECTION VALUE X
S120
YES
S103
DETERMINE DETECTION VALUE Xa IN PATTERN FORMING REGION A
DEFINE CORRECTION VALUE X AS DETECTION VALUE Xa
X ← Xa
S104
PERFORM PRINTING OPERATION USING CORRECTION VALUE X
S105
S106
IS PRINT REQUEST RECEIVED?
NO
YES
DETERMINE DETECTION VALUE Xc IN PATTERN FORMING REGION C
S107
DEFINE CORRECTION VALUE X AS AVERAGE VALUE OF DETECTION VALUES Xa AND Xc
X ← (Xa+Xc)/2
S108
PERFORM PRINTING OPERATION USING CORRECTION VALUE X
S109
1
2
S110
IS PRINT REQUEST RECEIVED?
NO
YES
DETERMINE DETECTION VALUE Xb IN PATTERN FORMING REGION B
S111
DEFINE CORRECTION VALUE X AS AVERAGE VALUE OF DETECTION VALUES Xa, Xb AND Xc
X ← (Xa+Xb+Xc)/3
S112
PERFORM PRINTING OPERATION USING CORRECTION VALUE X
S113
S114
IS PRINT REQUEST RECEIVED?
NO
YES
DETERMINE DETECTION VALUE Xd IN PATTERN FORMING REGION D
S115
S116
DEFINE CORRECTION VALUE X AS AVERAGE VALUE OF DETECTION VALUES Xa, Xb, Xc AND Xd
X ← (Xa+Xb+Xc+Xd)/4
S117
STORE, ON NVRAM, CORRECTION VALUE X DETERMINED BASED ON PATTERNS FORMED THROUGHOUT A CIRCUIT OF BELT
PERFORM PRINTING OPERATION USING CORRECTION VALUE X
S118
1
2

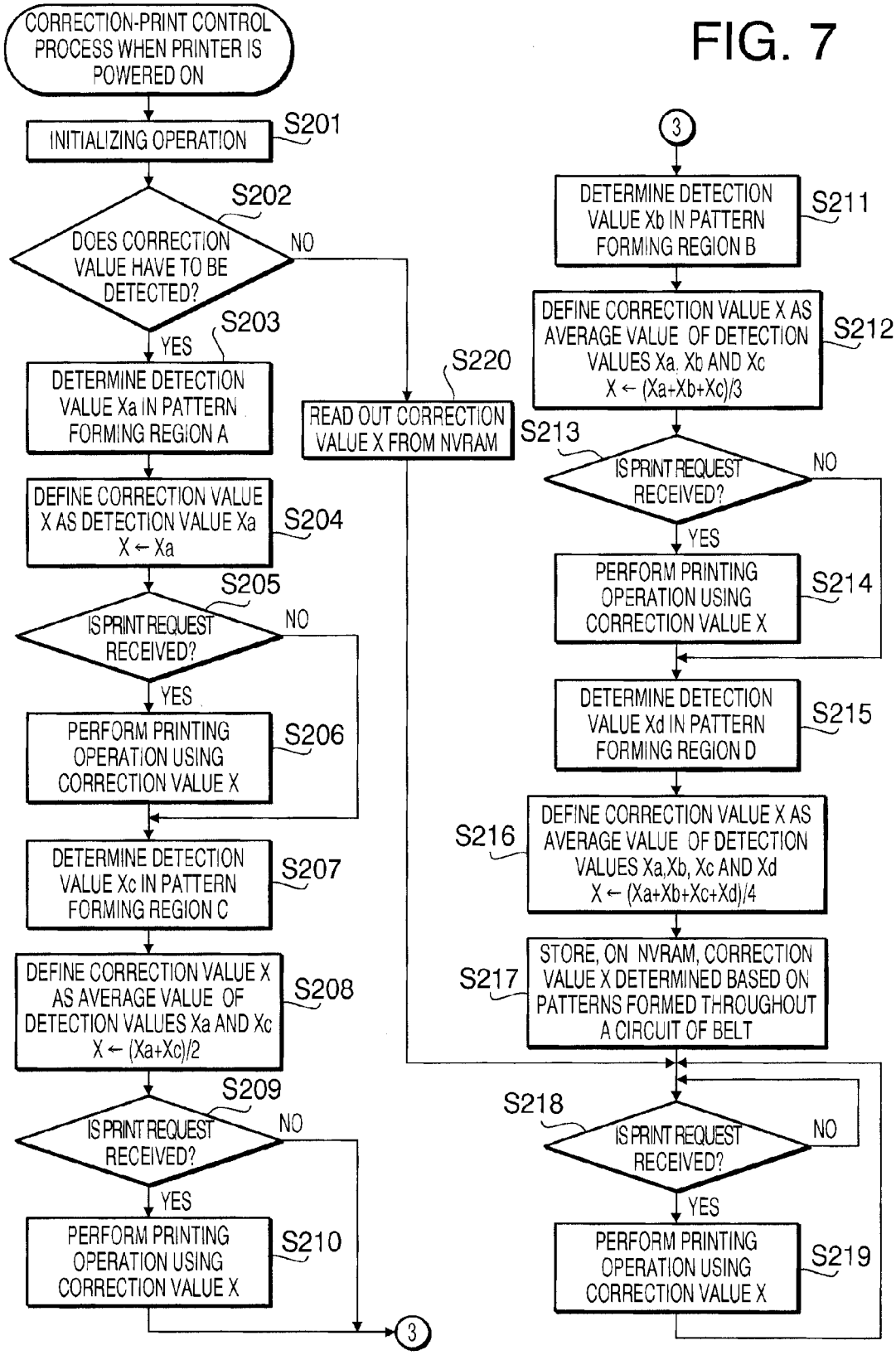
FIG. 7
CORRECTION-PRINT CONTROL PROCESS WHEN PRINTER IS POWERED ON
INITIALIZING OPERATION
S201
S202
DOES CORRECTION VALUE HAVE TO BE DETECTED?
NO
YES
S203
DETERMINE DETECTION VALUE Xa IN PATTERN FORMING REGION A
DEFINE CORRECTION VALUE X AS DETECTION VALUE Xa X ← Xa
S204
S205
IS PRINT REQUEST RECEIVED?
NO
YES
PERFORM PRINTING OPERATION USING CORRECTION VALUE X
S206
DETERMINE DETECTION VALUE Xc IN PATTERN FORMING REGION C
S207
DEFINE CORRECTION VALUE X AS AVERAGE VALUE OF DETECTION VALUES Xa AND Xc X ← (Xa+Xc)/2
S208
S209
IS PRINT REQUEST RECEIVED?
NO
YES
PERFORM PRINTING OPERATION USING CORRECTION VALUE X
S210
3
S220
READ OUT CORRECTION VALUE X FROM NVRAM
3
DETERMINE DETECTION VALUE Xb IN PATTERN FORMING REGION B
S211
DEFINE CORRECTION VALUE X AS AVERAGE VALUE OF DETECTION VALUES Xa, Xb AND Xc X ← (Xa+Xb+Xc)/3
S212
S213
IS PRINT REQUEST RECEIVED?
NO
YES
PERFORM PRINTING OPERATION USING CORRECTION VALUE X
S214
DETERMINE DETECTION VALUE Xd IN PATTERN FORMING REGION D
S215
S216
DEFINE CORRECTION VALUE X AS AVERAGE VALUE OF DETECTION VALUES Xa,Xb, Xc AND Xd X ← (Xa+Xb+Xc+Xd)/4
S217
STORE, ON NVRAM, CORRECTION VALUE X DETERMINED BASED ON PATTERNS FORMED THROUGHOUT A CIRCUIT OF BELT
S218
IS PRINT REQUEST RECEIVED?
NO
YES
PERFORM PRINTING OPERATION USING CORRECTION VALUE X
S219

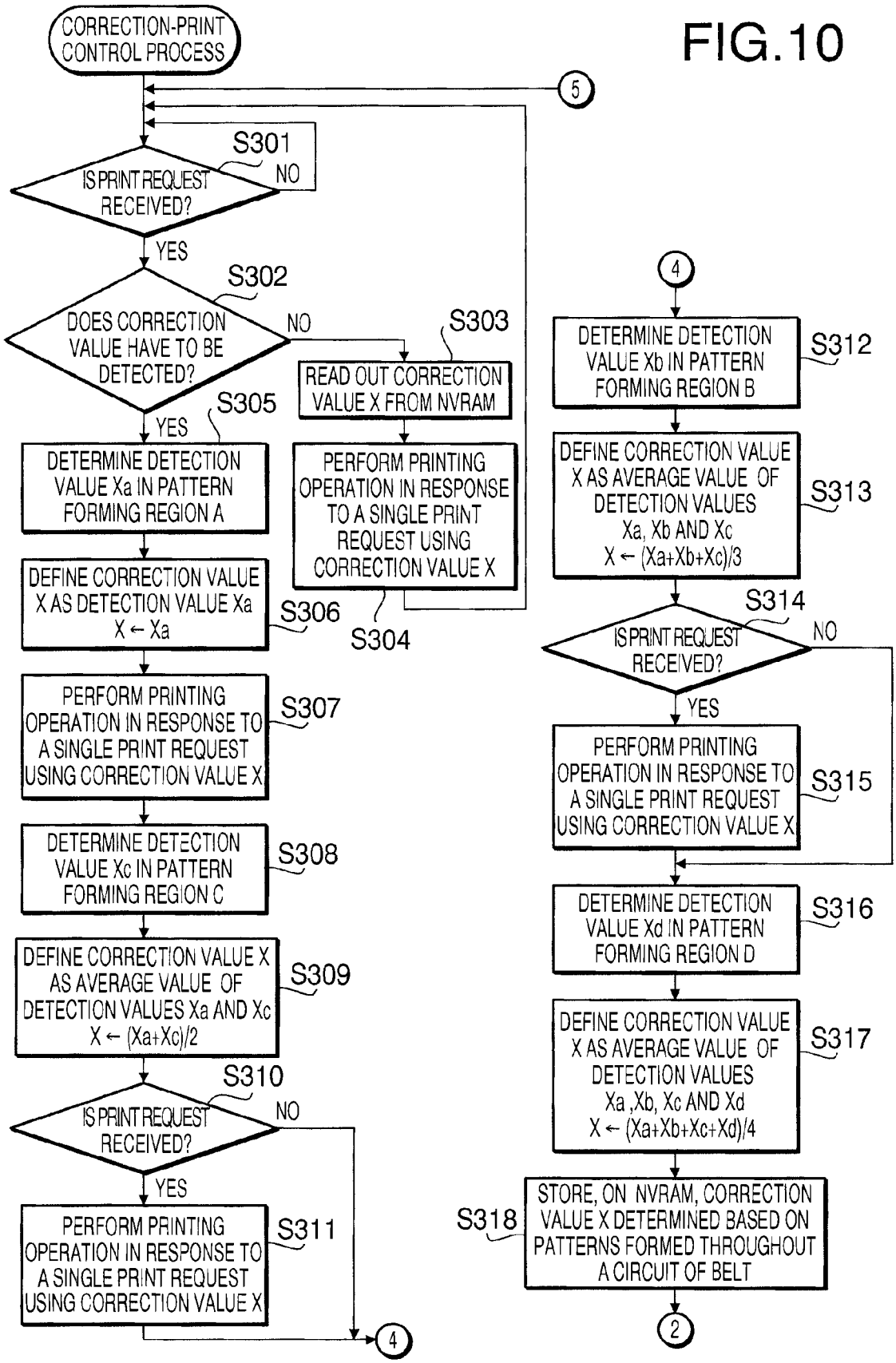
FIG.10
CORRECTION-PRINT CONTROL PROCESS
5
S301
IS PRINT REQUEST RECEIVED?
NO
YES
S302
DOES CORRECTION VALUE HAVE TO BE DETECTED?
NO
S303
READ OUT CORRECTION VALUE X FROM NVRAM
S304
PERFORM PRINTING OPERATION IN RESPONSE TO A SINGLE PRINT REQUEST USING CORRECTION VALUE X
YES
S305
DETERMINE DETECTION VALUE Xa IN PATTERN FORMING REGION A
DEFINE CORRECTION VALUE X AS DETECTION VALUE Xa X ← Xa
S306
PERFORM PRINTING OPERATION IN RESPONSE TO A SINGLE PRINT REQUEST USING CORRECTION VALUE X
S307
DETERMINE DETECTION VALUE Xc IN PATTERN FORMING REGION C
S308
DEFINE CORRECTION VALUE X AS AVERAGE VALUE OF DETECTION VALUES Xa AND Xc X ← (Xa+Xc)/2
S309
S310
IS PRINT REQUEST RECEIVED?
NO
YES
PERFORM PRINTING OPERATION IN RESPONSE TO A SINGLE PRINT REQUEST USING CORRECTION VALUE X
S311
4
4
DETERMINE DETECTION VALUE Xb IN PATTERN FORMING REGION B
S312
DEFINE CORRECTION VALUE X AS AVERAGE VALUE OF DETECTION VALUES Xa, Xb AND Xc X ← (Xa+Xb+Xc)/3
S313
S314
IS PRINT REQUEST RECEIVED?
NO
YES
PERFORM PRINTING OPERATION IN RESPONSE TO A SINGLE PRINT REQUEST USING CORRECTION VALUE X
S315
DETERMINE DETECTION VALUE Xd IN PATTERN FORMING REGION D
S316
DEFINE CORRECTION VALUE X AS AVERAGE VALUE OF DETECTION VALUES Xa ,Xb, Xc AND Xd X ← (Xa+Xb+Xc+Xd)/4
S317
S318
STORE, ON NVRAM, CORRECTION VALUE X DETERMINED BASED ON PATTERNS FORMED THROUGHOUT A CIRCUIT OF BELT
2

IMAGE FORMING DEVICE, AND METHOD AND COMPUTER READABLE MEDIUM THEREFOR

CROSS-REFERENCE TO RELATED APPLICATION

This application claims priority under 35 U.S.C. §119 from Japanese Patent Application No. 2007-258859 filed on Oct. 2, 2007. The entire subject matter of the application is incorporated herein by reference.

BACKGROUND

1. Technical Field

The following description relates to one or more techniques to correct an image forming property of an image forming device.

2. Related Art

An image forming device such as a color laser printer has been known, which includes a plurality of image forming units aligned along a sheet carrying belt such that toner images of respective different colors are sequentially transferred onto a sheet being conveyed on the sheet carrying belt by the image forming units. In such an image forming device, when the respective toner images are transferred into different positions on the sheet by the image forming units, a formed image becomes a low-quality one.

In order to secure the quality of the image, a technique referred to as registration to correct positional deviations between the toner images transferred onto the sheet has been employed (for example, see Japanese Patent Provisional Publication No. HEI8-118737). According to such a correction technique, a pattern including a plurality of marks is formed on a surface of the sheet carrying belt by each image forming unit, and the positional deviations between different color toner images are determined by detecting locations of the marks with an optical sensor. Then, based upon a result of the detection, the positional deviations between the toner images are corrected. Such positional deviation correction is performed prior to a printing operation, when a print request is received and it is determined that the positional deviation correction has to be executed.

Additionally, a similar technique has been known, in which a pattern for density correction is formed on a belt, a color density of the pattern is detected by an optical sensor, and based upon a result of the detection, a color density of an image to be formed is corrected.

SUMMARY

In each of the aforementioned corrections, correction accuracy is improved through highly accurate detection attained by a large number of detections of many marks formed on the belt, and thus print quality can be improved. However, unfortunately, it needs much time taken for the highly accurate detection, and therefore a user has to wait for a long time until the correction is completed.

Aspects of the present invention are advantageous to provide one or more improved image forming devices, methods, and computer readable media that make it possible to reduce a time period taken for correction of an image forming property and secure accuracy of the correction.

According to aspects of the present invention, an image forming device is provided, which includes an image forming unit configured to form an image on a sheet with an image forming property, a pattern forming unit configured to form a pattern on an object, a detection value determining unit configured to determine a first detection value representing the image forming property of the image forming unit through detecting the pattern formed on the object by the pattern forming unit, a storage unit configured to store thereon the first detection value determined by the detection value determining unit, a correction value determining unit configured to determine a correction value for correcting the image forming property with the first detection value stored on the storage unit and a second detection value that has previously stored on the storage unit, and a control unit configured to control the image forming unit to form the image with the image forming property corrected based upon the correction value determined by the correction value determining unit.

In some aspects of the present invention, the correction value for correcting the image forming property is determined using the first detection value stored on the storage unit and the second detection value that has previously stored on the storage unit. Thereby, even though so many detections of the pattern are not carried out at once, it is possible to secure a certain level of detection accuracy. Thus, it is possible to secure a certain level of correction accuracy even though the number of detections of the pattern is decreased to reduce a time period taken for the correction of the image forming property.

According to aspects of the present invention, further provided is a method to correct an image forming property of an image forming device having a storage unit. The method includes a pattern forming step of forming a pattern on an object, a detection value determining step of determining a first detection value representing the image forming property through detecting the pattern formed on the object in the pattern forming step, a storing step of storing, on the storage unit, the first detection value determined in the detection value determining step, a correction value determining step of determining a correction value for correcting the image forming property with the first detection value stored on the storage unit in the storing step and a second detection value that has previously stored on the storage unit, and an image forming step of forming an image with the image forming property corrected based upon the correction value determined in the correction value determining step.

In the method configured as above, the same effect as the aforementioned image forming device can be provided. Namely, the correction value for correcting the image forming property is determined using the first detection value stored on the storage unit and the second detection value that has previously stored on the storage unit. Thereby, even though so many detections of the pattern are not carried out at once, it is possible to secure a certain level of detection accuracy. Thus, it is possible to secure a certain level of correction accuracy even though the number of detections of the pattern is decreased to reduce a time period taken for the correction of the image forming property.

According to aspects of the present invention, further provided is a computer readable medium having computer executable instructions stored thereon. The instructions cause an image forming device, which includes a storage unit, to perform a pattern forming step of forming a pattern on an object, a detection value determining step of determining a first detection value representing the image forming property through detecting the pattern formed on the object in the pattern forming step, a storing step of storing, on the storage unit, the first detection value determined in the detection value determining step, a correction value determining step of determining a correction value for correcting the image forming property with the first detection value stored on the storage unit in the storing step and a second detection value that has previously stored on the storage unit, and an image forming step of forming an image with the image forming property corrected based upon the correction value determined in the correction value determining step.

In the computer readable medium configured as above, the same effect as the aforementioned image forming device can be provided. Namely, the correction value for correcting the image forming property is determined using the first detection value stored on the storage unit and the second detection value that has previously stored on the storage unit. Thereby, even though so many detections of the pattern are not carried out at once, it is possible to secure a certain level of detection accuracy. Thus, it is possible to secure a certain level of correction accuracy even though the number of detections of the pattern is decreased to reduce a time period taken for the correction of the image forming property.

BRIEF DESCRIPTION OF THE ACCOMPANYING DRAWINGS

FIG. 3 is a flowchart showing a procedure of a correction-print control process in the first embodiment according to one or more aspects of the present invention.

FIG. 7 is a flowchart showing a procedure of a correction-print control process in a second embodiment according to one or more aspects of the present invention.

FIG. 10 is a flowchart showing a procedure of a correction-print control process in a third embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

Hereinafter, embodiments according to aspects of the present invention will be described with reference to the accompany drawings.

First Embodiment (Overall Configuration of Printer)

Figure 1:
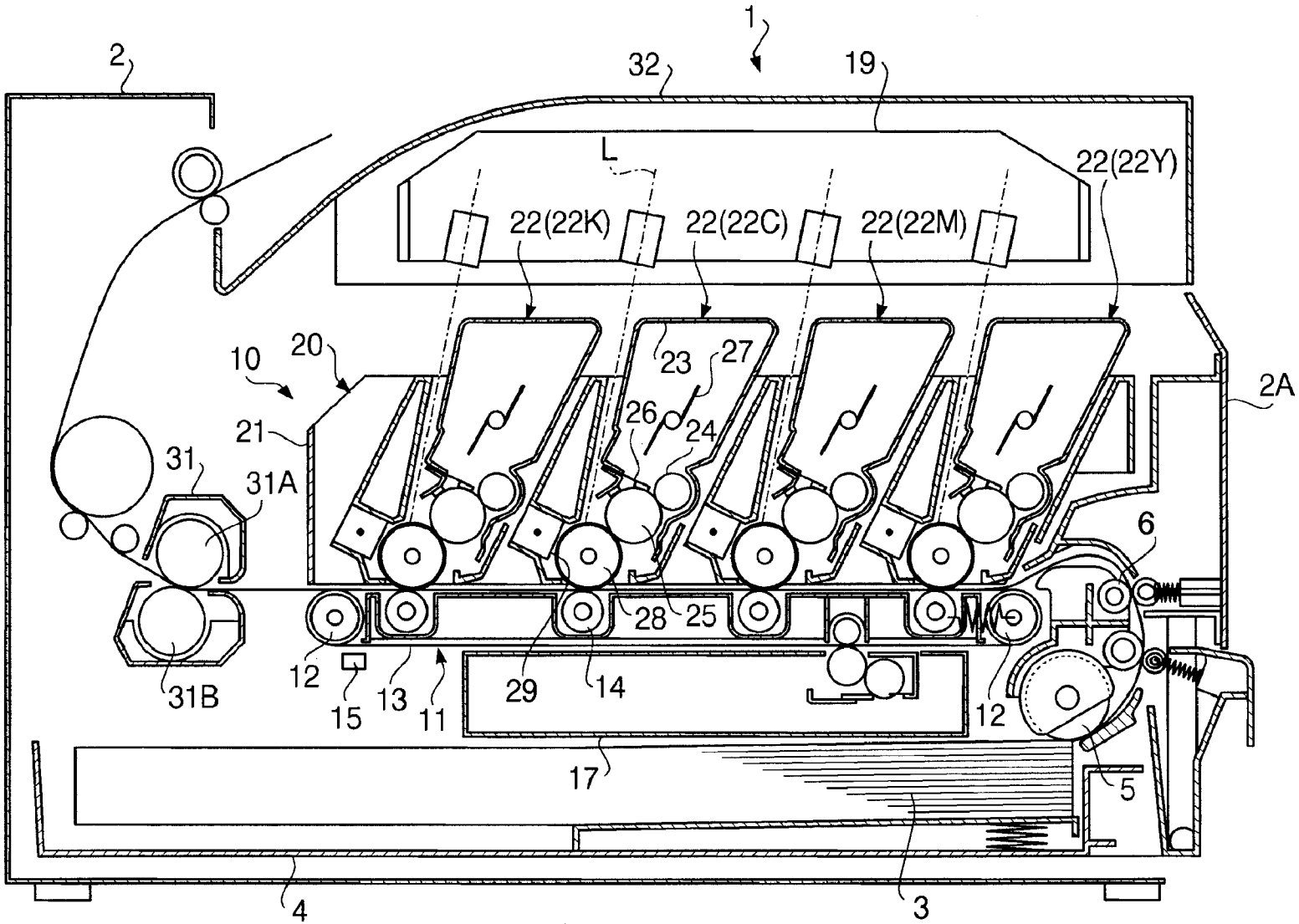
FIG. 1 is a cross-sectional side view schematically showing a configuration of a printer in a first embodiment according to one or more aspects of the present invention.

FIG. 1 is a cross-sectional side view schematically showing a configuration of a printer 1 according to aspects of the present invention. It is noted that the following description will be given under an assumption that a right side of FIG. 1 is defined as a front side of the printer 1.

The printer 1 is provided with a casing 2. At a bottom of the casing 2, a sheet feed tray 4 is provided, which is configured to be loaded with one or more sheets 3 as recording media. On an upper front side of the sheet feed tray 4, a sheet feed roller 5 is provided. Along with rotation of the sheet feed roller 5, a top sheet 3 placed in the sheet feed tray 4 is conveyed to a registration roller 6. After skew correction of the sheet 3, the registration roller 6 carries the sheet 3 onto a belt unit 11 of an image forming unit 10.

The image forming unit 10 includes the belt unit 11, a scanner unit 19, a process unit 20, and a fixing unit 31.

The belt unit 11 is configured with a belt 13 made of polycarbonate being strained around a pair of front and rear belt supporting rollers 12. When the rear belt supporting roller 12 is driven and rotated, the belt 13 is revolved in a counterclockwise direction, and the sheet 3 on the belt 13 is conveyed backward. Further, inside the belt 13, transfer rollers 14 are provided to face respective photoconductive drums 28 of the process unit 20 via the belt 13.

Additionally, a pair of pattern detecting sensors 15, configured to detect a pattern formed on the belt 13, is provided to face a lower side surface of the belt 13. The pattern detecting sensors 15 are configured to emit light onto the surface of the belt 13, receive the light reflected by the surface of the belt 13 with a phototransistor, and output a signal of a level corresponding to an intensity of the received light. Further, at a lower side of the belt unit 11, a cleaning unit 17 is provided, which is configured to collect toner and/or paper dusts adhered to the surface of the belt 13.

The scanner unit 19 is configured to illuminate a surface of each photoconductive drum 28 with a laser beam L emitted by a laser emitting unit (not shown) corresponding to each color.

The process unit 20 includes a frame 21 and development cartridges 22 (22Y, 22M, 22C, and 22K) corresponding to respective four colors (yellow, magenta, cyan, and black), which cartridges are detachably attached to four cartridge attachment portions provided to the frame, respectively. It is noted that the process unit 20 is configured to be drawn forth when a front cover 2A provided at a front of the casing 2 is opened. Further, in a state where the process unit 20 is detached from the casing 2, the belt unit 11 and the cleaning unit 17 can be attached to and detached from the casing 2. At a lower side of the frame 21, a photoconductive drum 28, of which a surface is covered with a photoconductive layer having a property to be positively charged, and a scorotron type charger 29 are provided to correspond to each development cartridge 22.

Each development cartridge 22 includes, at an upper side in a box-shaped casing, a toner container 23 configured to store therein toner as developer of each color. Further, each development cartridge 22 includes, under the toner container 23, a supply roller 24, a development roller 25, a layer thickness controlling blade 26, and an agitator 27. Some toner in the toner container 23 is supplied to the development roller 25 through rotation of the supply roller 24 and positively charged through friction between the supply roller 24 and the development roller 25. Further, the toner supplied onto the development roller 25 is introduced into between the layer thickness controlling blade 26 and the development roller 25 through rotation of the development roller 25. Then, the toner is sufficiently charged due to friction here and held on the development roller 25 as a thin layer with a constant thickness.

In an image forming operation, the photoconductive drum 28 is rotated, and thereby the surface of the photoconductive drum 28 is evenly and positively charged by the charger 29. Then, the positively charged surface is exposed through fast scanning with the laser beam emitted by the scanner unit 19, and an electrostatic latent image corresponding to an image to be formed on the sheet 3 is formed on the surface of the photoconductive drum 28.

Subsequently, when contacting the photoconductive drum 28 through the rotation of the development roller 25, the positively charged toner held on the development roller 25 is supplied to the electrostatic latent image formed on the surface of the photoconductive drum 28. Thereby, a toner image formed with the toner adhered to the exposed portions thereon is held on the surface of the photoconductive drum 28, and thus the electrostatic latent image on the photoconductive drum 28 is visualized.

After that, the toner image held on the surface of each photoconductive drum 28 is sequentially transferred onto the sheet 3 by a negative transfer voltage applied to the transfer roller 14 while the sheet 3 conveyed on the belt 13 passes through a transfer position between the photoconductive drum 28 and the transfer roller 14. Then, the sheet 3 with the toner image thus transferred thereon is conveyed to the fixing unit 31.

The fixing unit 31 includes a heating roller 31A having a heating source and a pressing roller 31B configured to press the sheet 3 against the heating roller 31A. The fixing unit 31 is configured to thermally fix the toner image transferred onto the sheet 3. Then, the sheet 3 with the toner image fixed thereon is conveyed upward and discharged onto a catch tray 32 provided on an upper face of the casing 2.

(Electrical Configuration of Printer)

Figure 2:
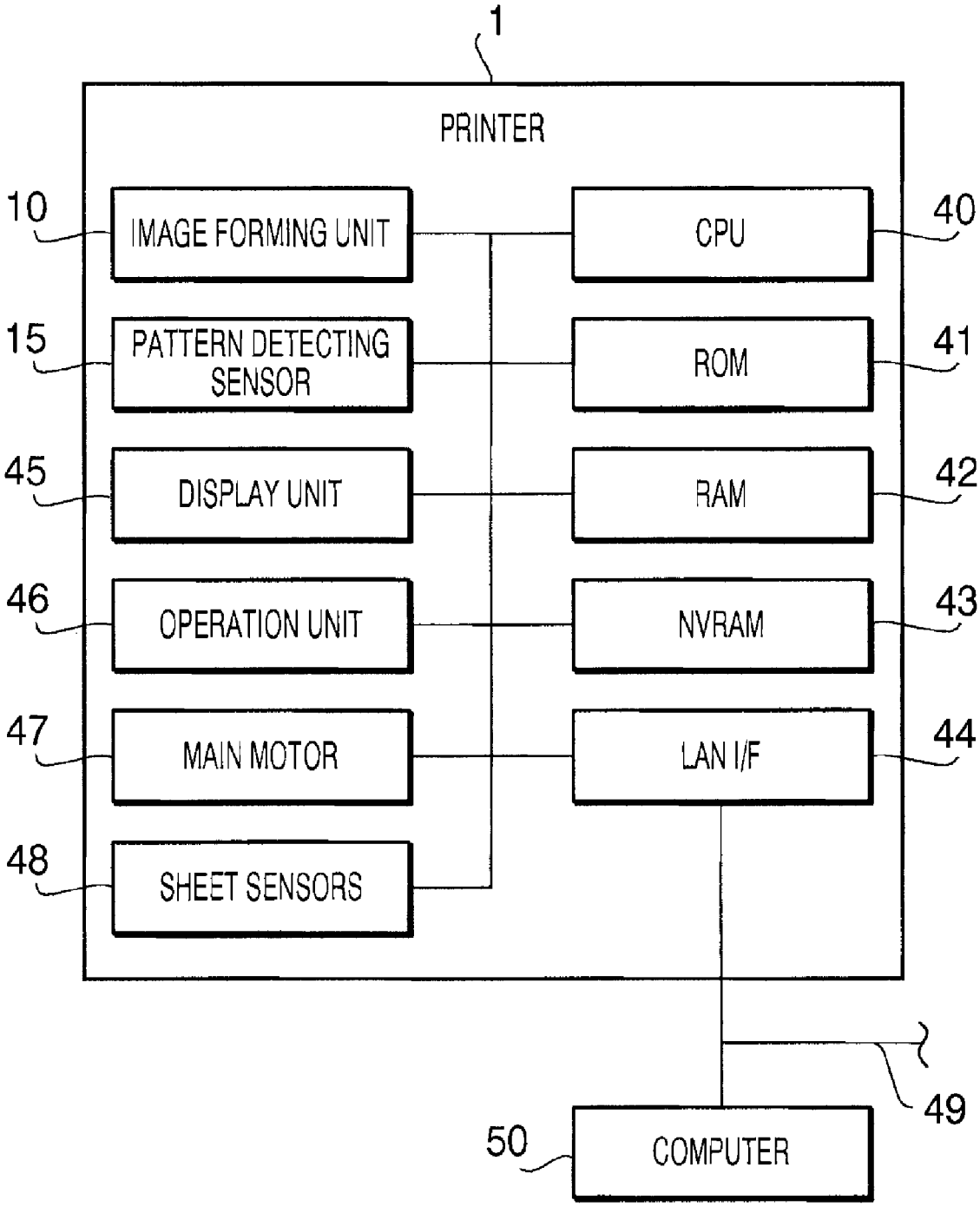
FIG. 2 is a block diagram showing an electrical configuration of the printer in the first embodiment according to one or more aspects of the present invention.

FIG. 2 is a block diagram showing an electrical configuration of the printer 1. As shown in FIG. 2, the printer 1 includes a CPU 40, a ROM 41, a RAM 42, a NVRAM 43, and a network interface 44, which are connected with the image forming unit 10, the pattern detecting sensors 15, a display unit 45, an operation unit 46, a main motor 47, and sheet sensors 48.

The ROM 41 stores thereon programs for executing various operations of the printer 1 such as a below-mentioned positional deviation correcting operation. The CPU 40 controls each element included in the printer 1 in accordance with a program read out from the ROM 41 while saving processing results onto the RAM 42 or the NVRAM 43. The network interface 44 is linked with the external computer 50 via a communication line 49 to attain mutual data communication therebetween.

The display unit 45 is provided with a liquid crystal display (LCD) and lamps and configured to display various setting screens and an operational status of the printer 1. The operation unit 46 is provided with buttons and configured to accept various user inputs through the buttons.

The main motor 47 is configured to rotate the registration roller 6, the belt supporting rollers 12, the transfer rollers 14, the development rollers 25, the photoconductive drums 28, and the heating roller 31A while synchronizing them. The sheet sensors 48 are disposed in a plurality of positions on a carrying route of the sheet 3 and configured to detect whether the sheet 3 is present in the respective positions.

(Correction-Print Control Process)

Figure 4:
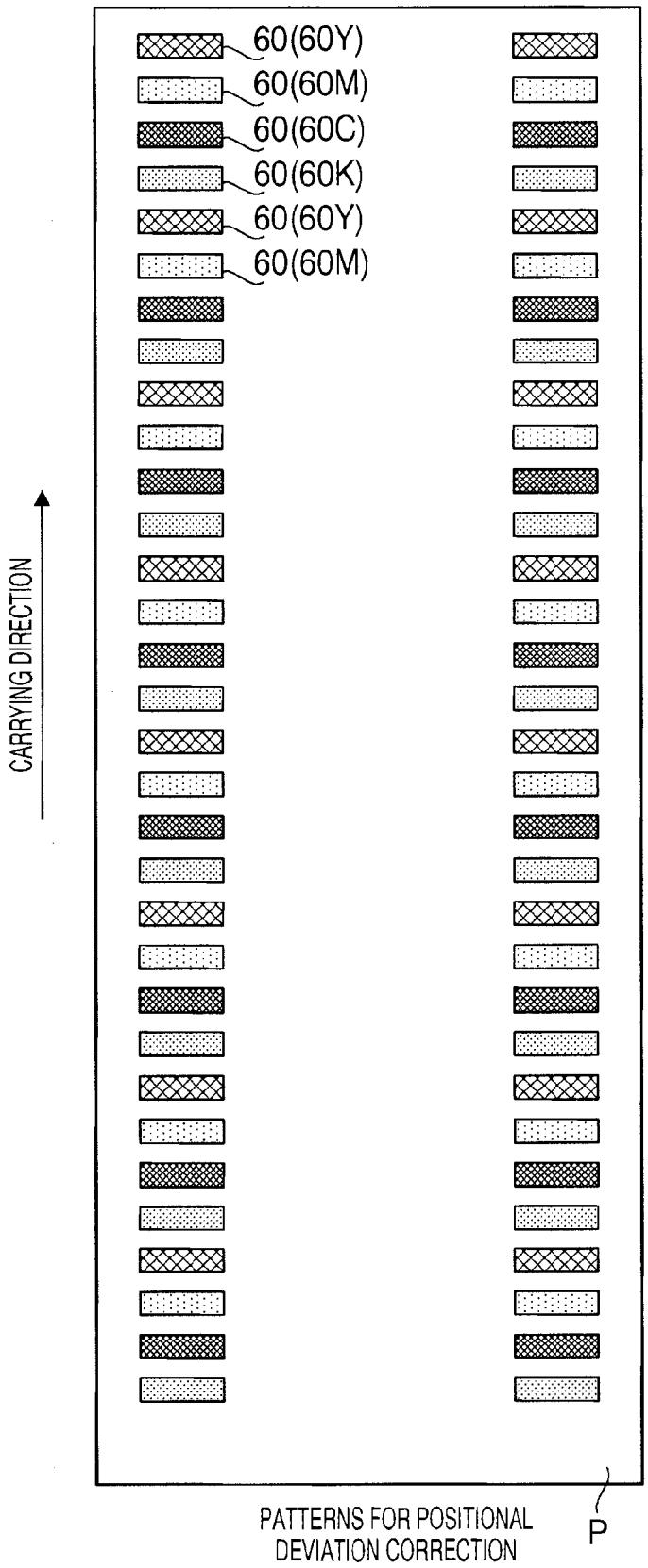
FIG. 4 is a schematic diagram showing a pattern for positional deviation correction in the first embodiment according to one or more aspects of the present invention.
Figure 5:
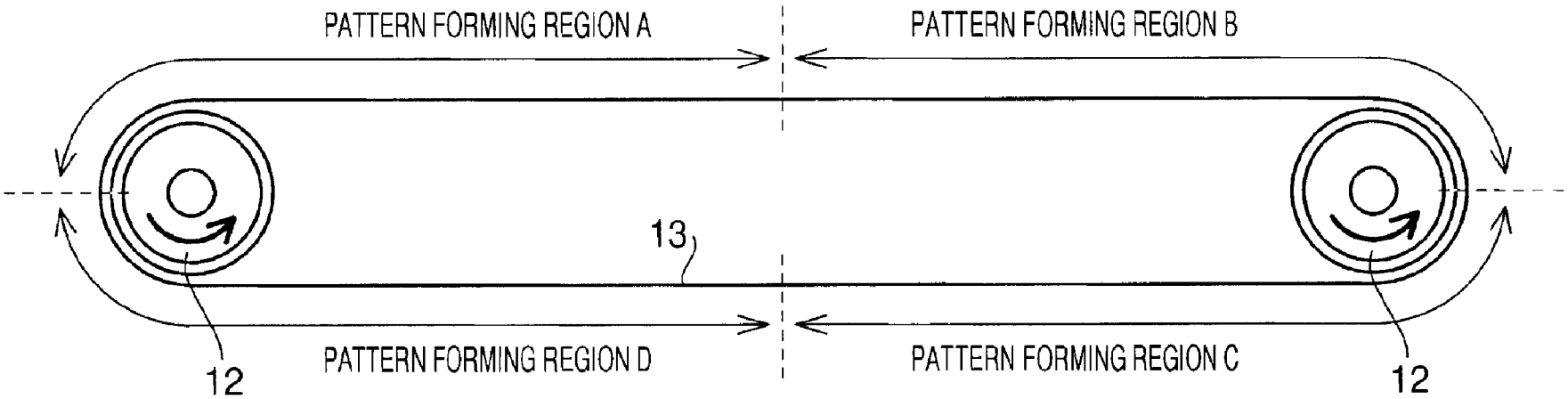
FIG. 5 is a schematic diagram showing pattern forming regions on a belt in the first embodiment according to one or more aspects of the present invention.

Subsequently, a correction-print control process to be controlled by the CPU 40 will be described. FIG. 3 is a flowchart showing procedure of a correction-print control process. FIG. 4 is a schematic diagram showing a pattern P for positional deviation correction. FIG. 5 is a schematic diagram showing pattern forming regions on the belt 13 within which the pattern P is formed.

When launching the correction-print control process, the CPU 40 first determines whether a print request is received from the external computer 50 via the network interface 44 (S101). When no print request is received (S101: No), the CPU 40 waits for a print request to be received. When a print request is received (S101: Yes), the CPU 40 next determines whether to detect a correction value for positional deviation correction (S102).

The CPU 40, on a steady basis, monitors a status of the printer 1 at intervals of a predetermined time period to determine whether the positional deviation correction is needed. More specifically, for example, when a predetermined condition is satisfied such that a paper jam is caused in execution of printing or that the number of pages printed after a previous positional deviation correction reaches a predetermined number, a correction request flag stored on the RAM 42 is set on. It is noted that, when the sheet 3 being conveyed is not detected by each sheet sensor 48 at a predetermined timing, the CPU 40 determines that a paper jam happens.

In S102, when the correction request flag is set on or no correction value is stored on the NVRAM 43, the CPU 40 determines that a correction value has to be detected (S102: Yes), and a following correcting operation (S103 and S104) are executed.

The pattern P for the positional deviation correction formed on the belt 13 is, as illustrated in FIG. 4, provided with a plurality of marks 60 aligned in row on each side of the belt 13. It is noted that the aforementioned pattern detecting sensors 15 are disposed to face the marks 60 of the respective rows.

The marks 60 are disposed at intervals of a predetermined distance in a carrying direction of the sheet 3. A plurality of groups are repeatedly provided, each of which includes four kinds of marks 60 formed with the four colors used in the process unit 20, respectively, in a predetermined order (for example, in an order of a yellow mark 60Y, a magenta mark 60M, a cyan mark 60C, and a black mark 60K). Further, a length range within a single pattern P is formed is one fourth as long as a circuit of the belt 13. As shown in FIG. 5, a surface of the belt 13 is divided into four pattern forming regions A to D of the same length in a circumferential direction of the belt 13. A single pattern P for the positional deviation correction is formed in any of the four pattern forming regions A to D.

In the correcting operation, the CPU 40 first forms the pattern P in the pattern forming region A on the belt 13, and measures a positional deviation amount for each color based upon the pattern P (S103). Specifically, when the pattern forming region A reaches a position to face the pattern detecting sensors 15, the CPU 40 compares output levels of the pattern detecting sensors 15 with a predetermined threshold to detect a position of each mark 60. Then, with respect to the four marks 60 of each group, positional deviations from the black mark 60K are determined for respective marks 60 of the other three colors. Thereafter, an average value of the positional deviations determined for each of the three colors is defined as a detection value Xa.

Subsequently, the detection value Xa is stored on the RAM 42 as a correction value X (S104). Then, a printing operation is performed by the image forming unit 10 with the correction value X (S105). More specifically, print data of each color to be transmitted to the scanner unit 19 is corrected based upon the correction value X to adjust a writing position of an image on each photoconductive drum 28. It is noted that, when a plurality of print requests are received before the current printing operation is completed, printing operations for all the print requests received are sequentially executed.

After that, the CPU 40 waits for a print request to be received (S106). When a print request is received (S106: Yes), the pattern P is formed in the pattern forming region C on the belt 13, and, in the same manner as described above, the measurement and the calculation are made based upon the pattern P to determine a detection value Xc (S107). Next, the CPU 40 determines an average value between the previously acquired detection value Xa and the newly acquired detection value Xc ((Xa+Xc)/2). The CPU 40 replaces the previous correction value X stored on the RAM 42 with the determined average value defined as a new correction value X (S108). Then, a printing operation is performed with the correction value X newly defined (S109).

Subsequently, the CPU 40 waits for a print request to be received (S110). When a print request is received (S110: Yes), the pattern P is formed in the pattern forming region B on the belt 13, and, in the same manner as described above, the measurement and the calculation are made based upon the pattern P to determine a detection value Xb (S111). Next, the CPU 40 determines an average value of the acquired detection values Xa, Xb, and Xc ((Xa+Xb+Xc)/3), and stores the average value on the RAM 42 as a new correction value X (S112). Then, a printing operation is performed with the correction value X (S113).

Furthermore, the CPU 40 waits for a print request to be received (S114). When a print request is received (S114: Yes), the pattern P is formed in the pattern forming region D on the belt 13, and, in the same manner as described above, the measurement and the calculation are made based upon the pattern P to determine a detection value Xd (S115). Then, the CPU 40 determines an average value of the acquired detection values Xa, Xb, Xc, and Xd ((Xa+Xb+Xc+Xd)/4), and stores the average value on the RAM 42 as a new correction value X (S116).

Next, the CPU 40 stores the correction value X on the NVRAM 43 (S117). The correction value X is obtained through the measurement based upon the four patterns P as long as a single circuit of the belt 13. Therefore, an influence of periodic variation of the detection values due to revolution of the belt 13 on the correction value X is so restrained that the correction value X is considered as a relatively reliable value. Then, a printing operation is performed with the correction value X (S118). Thereafter, the present process goes back to S101.

Meanwhile, when determining in S102 that a correction value does not have to be detected (S102: No), the CPU 40 reads out the correction value X from the NVRAM 43 (S119). Then, a printing operation is executed with the correction value X (S120).

Figure 6:
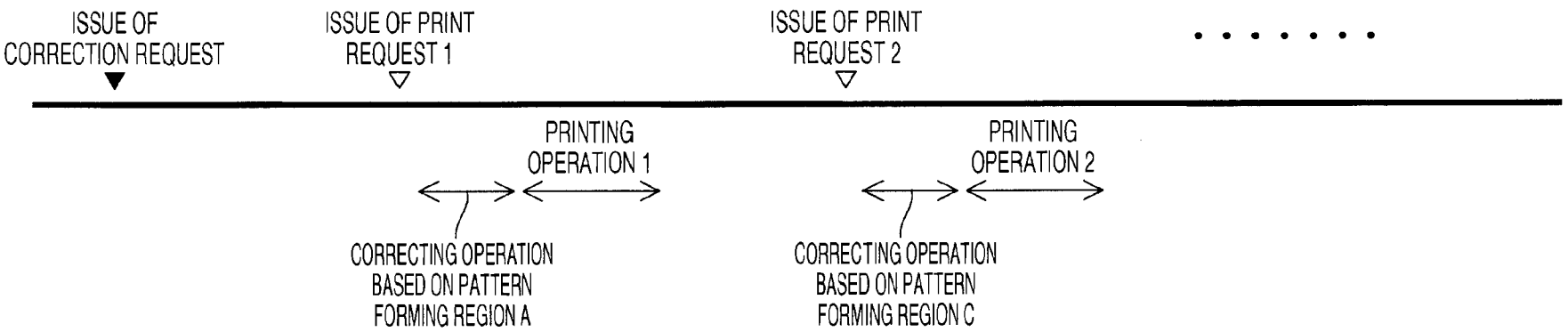
FIG. 6 is a schematic diagram exemplifying an execution timing of each operation in the correction-print control process in the first embodiment according to one or more aspects of the present invention.

FIG. 6 is a schematic diagram exemplifying an execution timing of each operation in the correction-print control process. As illustrated in FIG. 6, when a print request 1 is received after the correction request flag is set on, the CPU 40 first forms the pattern P in the pattern forming region A, and performs the correcting operation based upon the pattern P in the pattern forming region A (S103 and S104). Following completion of the correcting operation, a printing operation 1 is performed (S105). The correcting operation here is executed through the measurement based upon the pattern P one fourth as long as a single circuit of the belt 13. Therefore, correction accuracy of the correcting operation is lower than correction accuracy based upon the patterns P as long as a whole circuit of the belt 13. However, since the correcting operation here needs a shorter time, and thus a time period during which a user has to wait for printing to be completed can be reduced.

After that, the CPU 40 waits for a print request to be received (S106). When a print request 2 is received (S106: Yes), the CPU 40 forms the pattern P in the pattern forming region C, and performs the correcting operation based upon the pattern P in the pattern forming region C (S107 and S108). Subsequently, a printing operation 2 in response to the print request 2 is performed (S109). Thus, when a print request is received at intervals of a certain amount of time in a state where the correction request flag is set on, a single correcting operation is executed each time a print request is received, and a printing operation is performed, following completion of the correcting operation. The second correcting operation or a later-executed correcting operation is performed using detection results of the present correcting operation and one or more previous correcting operations. Therefore, it is possible to improve the correction accuracy.

(Effects of First Embodiment)

As described above, according to the first embodiment, the positional deviation correction is performed based upon a new detection result of the pattern P and one or more previous detection results. Thereby, even though a lot of marks 60 of the pattern P formed over a long range on the belt 13 are not detected at a time, a certain level of correction accuracy is secured. Thus, it is possible to reduce time taken for a single correction and secure correction accuracy.

Further, when there is no previous detection result stored on the RAM 42, the correction accuracy is not so high, yet the correction is desired to be executed based upon detection results acquired in a correcting operation in execution.

In general positional deviation correction, since detection values may vary due to revolution of the belt 13, a pattern for the positional deviation correction is formed throughout a circuit of the belt 13, and measurement is made for marks included in the pattern. However, according to the first embodiment, even though the pattern P is formed in a range shorter than a circuit of the belt 13, it is possible to ensure a certain level of correction accuracy and reduce time taken for the correction.

Further, in the first embodiment, the pattern P is formed in a different range in the circumferential direction on the belt 13 from a range in which the pattern P has previously been formed. Thereby, it is possible to restrain the influence of the periodic fluctuation of the detection vales accompanying the revolution of the belt 13.

Especially, in the first embodiment, the patterns P are formed in the pattern forming regions A to D in an order of "A, C, B, and D" that is different from an order in which the pattern forming regions A to D are arranged (i.e., an order of "A, B, C, and D"). For instance, when a correction value X is determined based upon the patterns P formed in the pattern forming regions A and B, the regions used for the determination of the correction value X are concentrated into a partial area on the belt 13. Therefore, the correction value X may significantly different from a correction value X determined through measurement based upon the patterns P formed throughout a circuit of the belt 13. On the contrary, in the first embodiment, it is possible to prevent the regions used for determination of a correction value X from being concentrated into a partial area on the belt 13. Thus, it is possible to prevent the correction value X from being significantly different from the correction value X determined through the measurement based upon the patterns P formed throughout a circuit of the belt 13.

Further, in the first embodiment, a range in which the pattern P is newly formed is located in a different position in the circumferential direction on the belt 13 from a range in which the pattern P has previously been formed, so as to eliminate overlap therebetween. Therefore, it is possible to more efficiently restrain the influence of periodic variation of the detection values due to the revolution of the belt 13.

Second Embodiment

Next, a second embodiment according to aspects of the present invention will be described with reference to FIGS. 7 to 9. FIG. 7 is a flowchart showing a procedure of a correction-print control process in the second embodiment. It is noted that, in each embodiment described below, a mechanical configuration of a printer 1 is the same as that of the first embodiment. Hence, the same elements of each below-mentioned embodiment as those of the first embodiment will be provided with the same reference characters, respectively, and explanations about them will be omitted.

The correction-print control process of the second embodiment is executed immediately after the printer 1 is powered on. When the printer 1 is turned on, as illustrated in FIG. 7, the CPU 40 performs a predetermined initializing operation such as initializing of the RAM 42 (S201). Subsequently, the CPU 40 determines whether to detect a correction value (namely, whether a correcting operation is required) (S202). Here, the CPU determines that a correction value has to be detected when the accuracy of a correction value stored on the NVRAM 43 is not secured, such as when no correction value is stored on the NVRAM 43, the printer 1 is powered off before acquiring the correction value based upon the patterns P formed throughout a circuit of the belt 13 in a previous correcting operation, the printer 1 is kept in a power-off state for more than a predetermined time period, and replacement of the development cartridge 22 is detected in the power-off state.

When the CPU 40 determines that a correction value has to be detected (S202: Yes), the pattern P is formed in the pattern forming region A on the belt 13, and a detection value Xa is determined based upon the pattern P in the pattern forming region A (S203). Then, the detection value Xa is stored on the RAM 42 as a correction value X to be employed in a printing operation (S204).

Subsequently, the CPU 40 determines whether a print request is received (S205). When a print request is received (S205: Yes), a printing operation is performed by the image forming unit 10 with the correction value X stored on the RAM 42 (S206).

When the printing operation in response to the print request is completed in S206, or no print request is received (S205: No), the pattern P is formed in the pattern forming region C on the belt 13, and in the same manner as described before, a detection value Xc is determined based upon the pattern P in the pattern forming region C (S207). Then, an average value of the acquired detection values Xa and Xc is determined and defined as a correction value X (S208).

Subsequently, the CPU 40 determines whether a print request is received (S209). When a print request is received (S209: Yes), a printing operation is performed by the image forming unit 10 with the correction value X stored on the RAM 42 (S210). After that, in the same fashion, the pattern P is formed in the pattern forming region B and a correcting operation is performed (S211 and S212). Then, the CPU 40 determines whether a print request is received (S213). When a print request is received (S213: Yes), a printing operation is performed with a correction value X that has been determined and stored on the RAM 42 in S212 (S214).

Further, the pattern P is formed in the pattern forming region D, and a correcting operation is performed (S215 and S216). Then, a correction value X is determined based upon the four patterns P formed throughout a circuit of the belt 13 (S216), and stored on the NVRAM 43 (S217).

Thereafter, the CPU 40 waits for a print request to be received (S218). When a print request is received (S218: Yes), a printing operation is performed with the correction value X stored on the NVRAM 43 (S219).

Meanwhile, when it is determined in S202 that a correction value does not have to be detected (S202: No), the CPU 40 reads out a correction value stored on the NVRAM 43 (S220). Then, in S218, the CPU 40 waits for a print request to be received.

Figure 8:
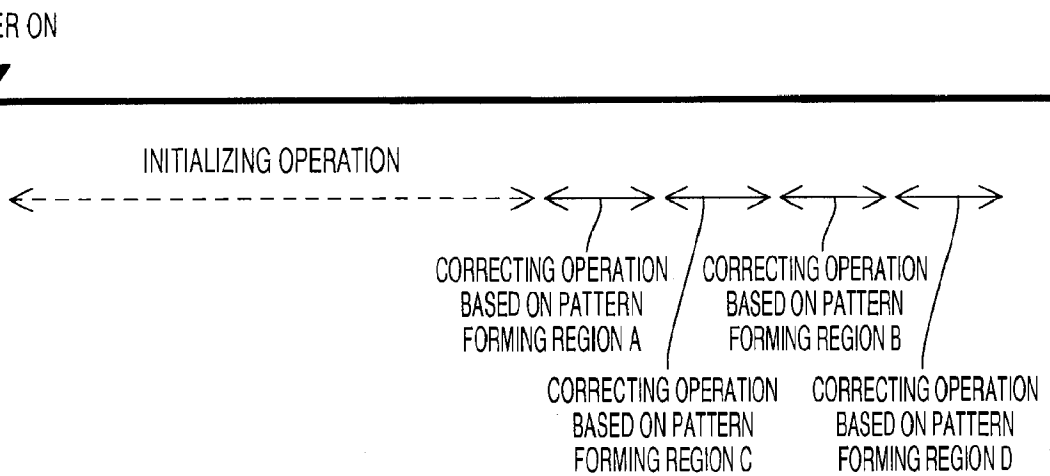
FIGS. 8 and 9 are schematic diagrams exemplifying an execution timing of each operation in the correction-print control process in the second embodiment according to one or more aspects of the present invention.
Figure 9:
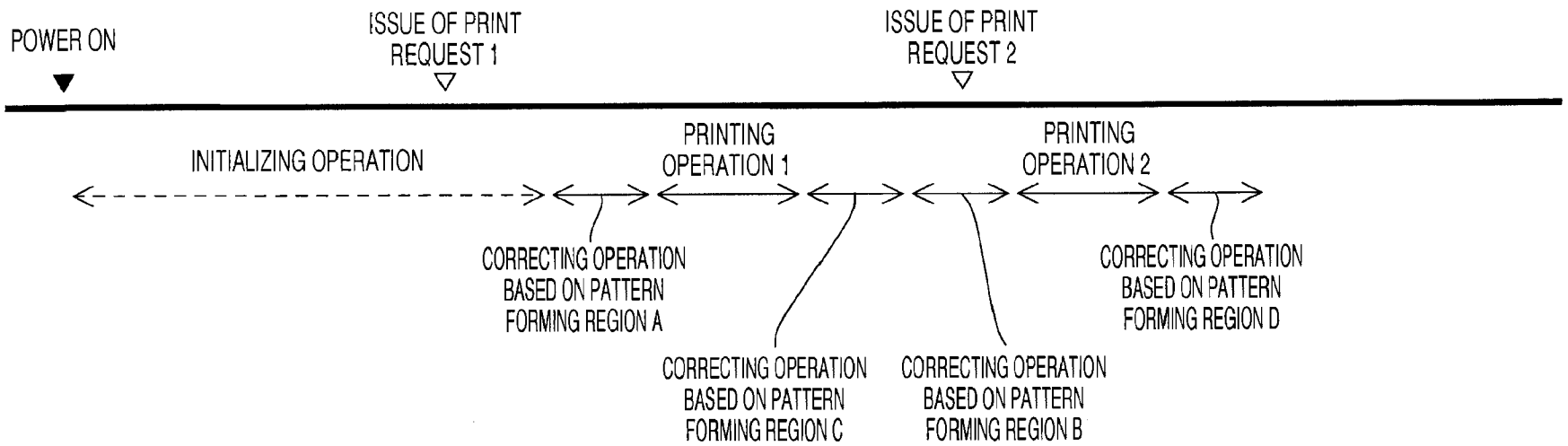

FIGS. 8 and 9 exemplify an execution timing of each operation in the aforementioned correction-print control process. As shown in FIG. 8, when no print request is received after the printer 1 is turned on, the correcting operation based upon the pattern P formed in the pattern forming region A (S203 and S204), the correcting operation based upon the pattern P formed in the pattern forming region C (S207 and S208), the correcting operation based upon the pattern P formed in the pattern forming region B (S211 and S212), the correcting operation based upon the pattern P formed in the pattern forming region D (S215 to S217) are sequentially executed immediately after the initializing operation.

Further, for instance, when a print request 1 is received in the initializing operation, as illustrated in FIG. 9, a correcting operation is performed based upon the pattern P formed in the pattern forming region A (S203, S204) subsequently after the initializing operation. Thereafter, a printing operation in response to the print request 1 is executed. When no print request is received after the printing operation, a correcting operation is performed based upon the pattern P in the pattern forming region C (S207, S208), and further a correcting operation is performed based upon the pattern P in the pattern forming region B (S211, S212). Here, for example, when a print request 2 is received in execution of the correcting operation based upon the pattern P formed in the pattern forming region B, after the correcting operation is completed, a printing operation in response to the print request 2 is executed (S214). Thereafter, a correcting operation based upon the pattern P formed in the pattern forming region D is carried out (S215 to S217).

In the second embodiment as well, for example, since the detection results in the pattern forming regions A and C are referred to in the correcting operation based upon the pattern P in the pattern forming region B, the detection accuracy can be improved. Thereby, it is possible to reduce a time period taken for a single correcting operation and secure the correction accuracy.

Third Embodiment

Next, a third embodiment according to aspects of the present invention will be described with reference to FIGS. 10 to 12. FIG. 10 is a flowchart showing a procedure of a correction-print control process in the third embodiment.

When the correction-print control process is started, the CPU 40 waits for a print request to be received (S301). When a print request is received (S301: Yes), the CPU 40 determines whether to detect a correction value for the positional deviation correction (S302). When it is determined that a correction value does not have to be detected (S302: No), such as when the correction request flag is set off, a correction value stored on the NVRAM 43 is read out (S303). Then, a printing operation is performed with the correction value (S304). It is noted that, in the third embodiment, only performed is a printing operation in response to a single print request at once. Thereafter, the present process goes back to S301, in which the CPU 40 waits for a print request to be received.

Meanwhile, when it is determined that a correction value has to be detected (S302: Yes), the pattern P is formed in the pattern forming region A on the belt 13, and a correcting operation is executed based upon the pattern P in the pattern forming region A to acquire a detection value Xa (S305). Then, the detection value Xa is defined as a correction value X (S306). Subsequently, a printing operation in response to the single print request is performed with the correction value X acquired (S307). Next, a correcting operation is performed based upon the pattern P formed in the pattern forming region A to acquire a detection value Xc. Then, a correction value X is determined as an average value of the detection values Xa and Xc (S308 and S309).

Subsequently, the CPU 40 determines whether there is a print request received (S310). When there is a print request received (S310: Yes), a printing operation in response to the single print request is performed using the correction value stored on the RAM 42 (S311). Meanwhile, when there is no print request received (S310: No), the present process advances to S312 without executing the printing operation in S311. Further, a correcting operation is performed based upon the pattern P formed in the pattern forming region B to acquire a detection value Xb (S312). Then, a correction value X is determined as an average value of the detection values Xa, Xb, and Xc (S312 and S313). Then, the CPU determines whether there is a print request received (S314). When there is a print request received (S314: Yes), a printing operation in response to the single print request is performed using the correction value X stored on the RAM 42 (S315). Meanwhile, when there is no print request received (S314: No), the present process advances to S316 without executing the printing operation in S315.

Further, a correcting operation is performed based upon the pattern P formed in the pattern forming region D to acquire a detection value Xd (S316). Then, a correction value X is determined as an average value of the detection values Xa, Xb, Xc, and Xd, based upon the four patterns P formed throughout a circuit of the belt 13 (S317). Then, the correction value X determined is stored on the NVRAM 43 (S318), and thereafter the present process goes back to S301.

Figure 11:
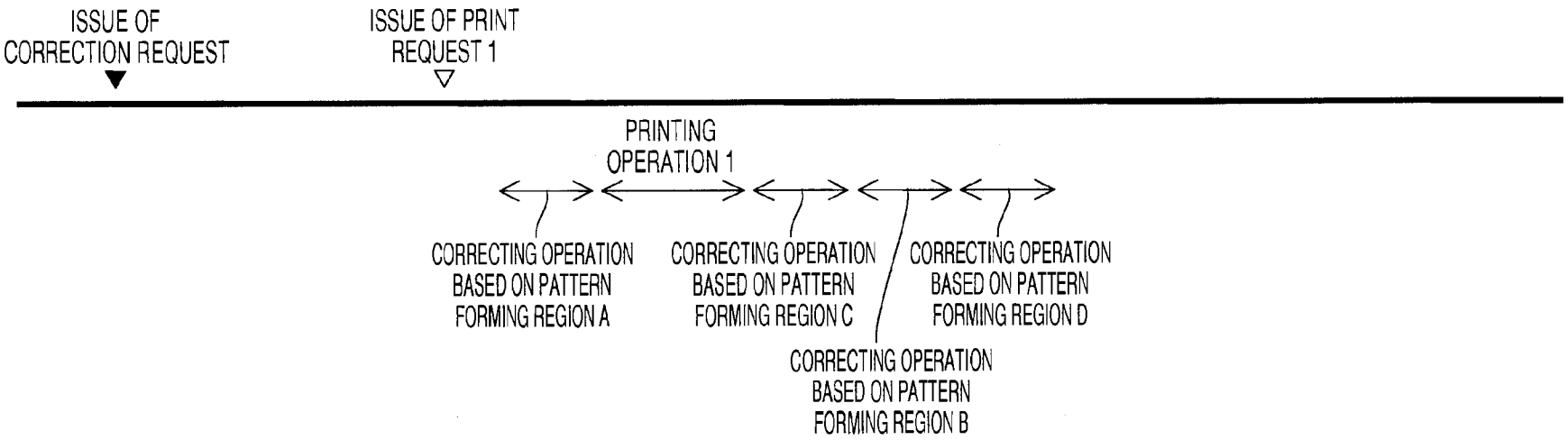
FIGS. 11 and 12 are schematic diagrams exemplifying an execution timing of each operation in the correction-print control process in the third embodiment according to one or more aspects of the present invention.
Figure 12:
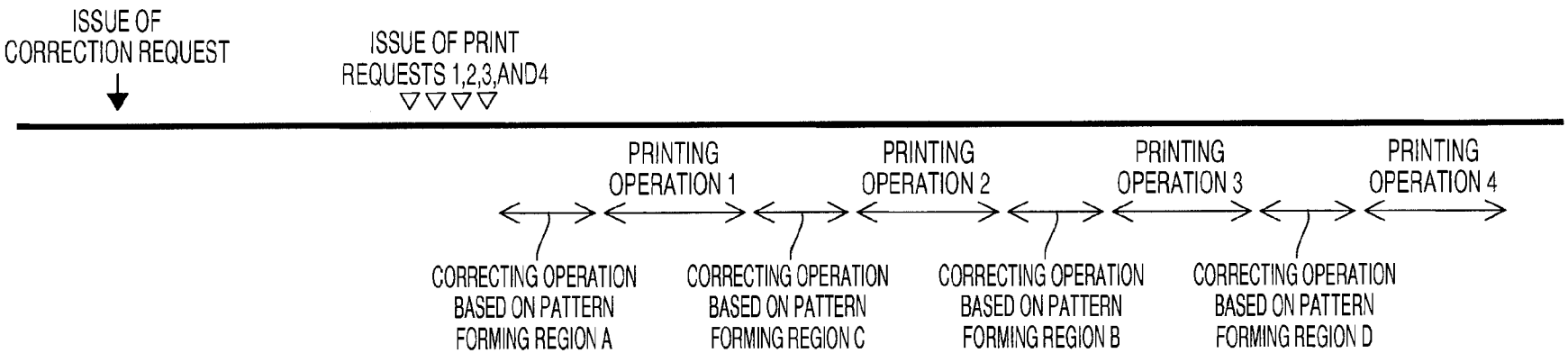

FIGS. 11 and 12 are schematic diagrams exemplifying an execution timing of each operation in the aforementioned correction-print control process. For instance, as shown in FIG. 11, when a print request 1 is received in a state where the correction request flag is set on, and another print request is not received for a predetermined time period after that, a correcting operation is first executed based upon the pattern P in the pattern forming region A (S305 and S306). After that, a printing operation in response to the print request 1 is executed. After completion of the printing operation, correcting operations, based upon the patterns P formed in the pattern forming regions C, B, and D, are performed in sequence.

Additionally, for example, as illustrated in FIG. 12, when four print requests 1 to 4 are sequentially received in a state where the correction request flag is set on, firstly, a correcting operation is performed based upon the pattern P formed in the pattern forming region A (S305 and S306). Next, a printing operation is performed in response to the print request 1 (S307). After completion of the printing operation, performed are, in sequence, a correcting operation based upon the pattern P formed in the pattern forming region C (S308 and S309), a printing operation in response to a print request 2 (S311), a correcting operation based upon the pattern P formed in the pattern forming region B (S312 and S313), a printing operation in response to a print request 3 (S315), a correcting operation based upon the pattern P formed in the pattern forming region D (S316 and S317), and a printing operation in response to a print request 4 (S304).

Thus, in the third embodiment as well, the second correcting operation or a later-executed correcting operation is performed using detection results of the present correcting operation and one or more previous correcting operations. Therefore, it is possible to improve the correction accuracy. In addition, the printing operation in response to each of at least the print requests 1 to 3 can be completed earlier than a printing operation performed after a correcting operation based upon the four patterns formed throughout a circuit of the belt 13.

Fourth Embodiment

Next, a fourth embodiment according to aspects of the present invention will be described with reference to FIGS. 13 to 18.

(Nullification Process)

Figure 13:
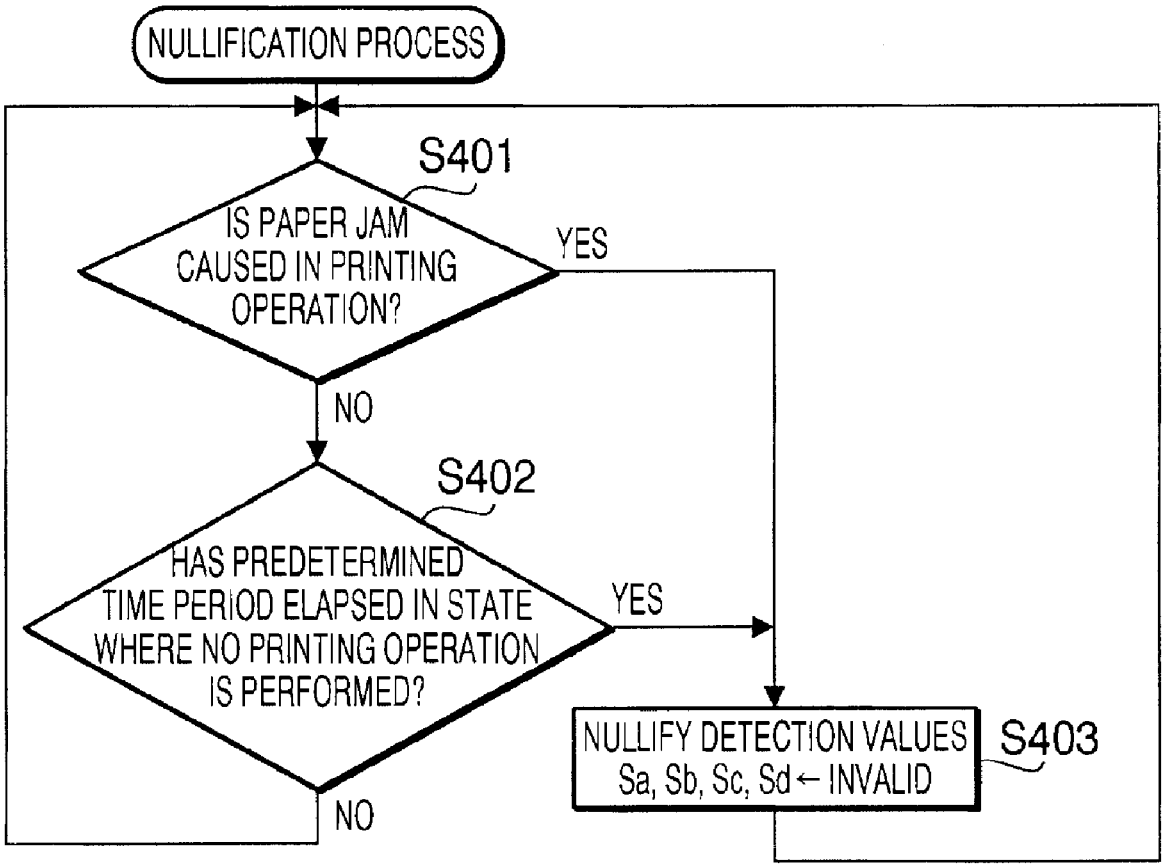
FIG. 13 is a flowchart showing a procedure of a nullification process in a fourth embodiment according to one or more aspects of the present invention.

FIG. 13 is a flowchart showing a procedure of a nullification process in the third embodiment. In the third embodiment, a nullification process is regularly performed under control by the CPU 40 to nullify the detection values Xa to Xd detected in the correction-print control process when a predetermined condition is satisfied. In the nullification process, firstly, the CPU 40 examines whether a paper jam is caused in execution of a printing operation (S401). When a paper jam is not caused (S401: No), the CPU 40 determines whether a predetermined time period has elapsed in a state where any printing operation is not performed (S402). When the predetermined time period has not elapsed (S402: No), the present process goes back to S401.

When a paper jam is caused (S401: Yes), or the predetermined time period has elapsed in a state where any printing operation is not performed (S402: Yes), validity flags Sa to Sd, which respectively represent whether the detection values Xa to Xd stored in the RAM 42 are valid or invalid, are set from valid states to invalid states, respectively (S403). It is noted that, besides the aforementioned conditions, for example, the nullification process may be carried out when one of other conditions is satisfied, such as a condition where replacement of a development cartridge 22 with a new one is detected, a condition where a predetermined time period has elapsed since a previous correcting operation, and a condition where a predetermined number of pages have been printed since the previous correcting operation.

(Correction-Print Control Process)

Figure 14:
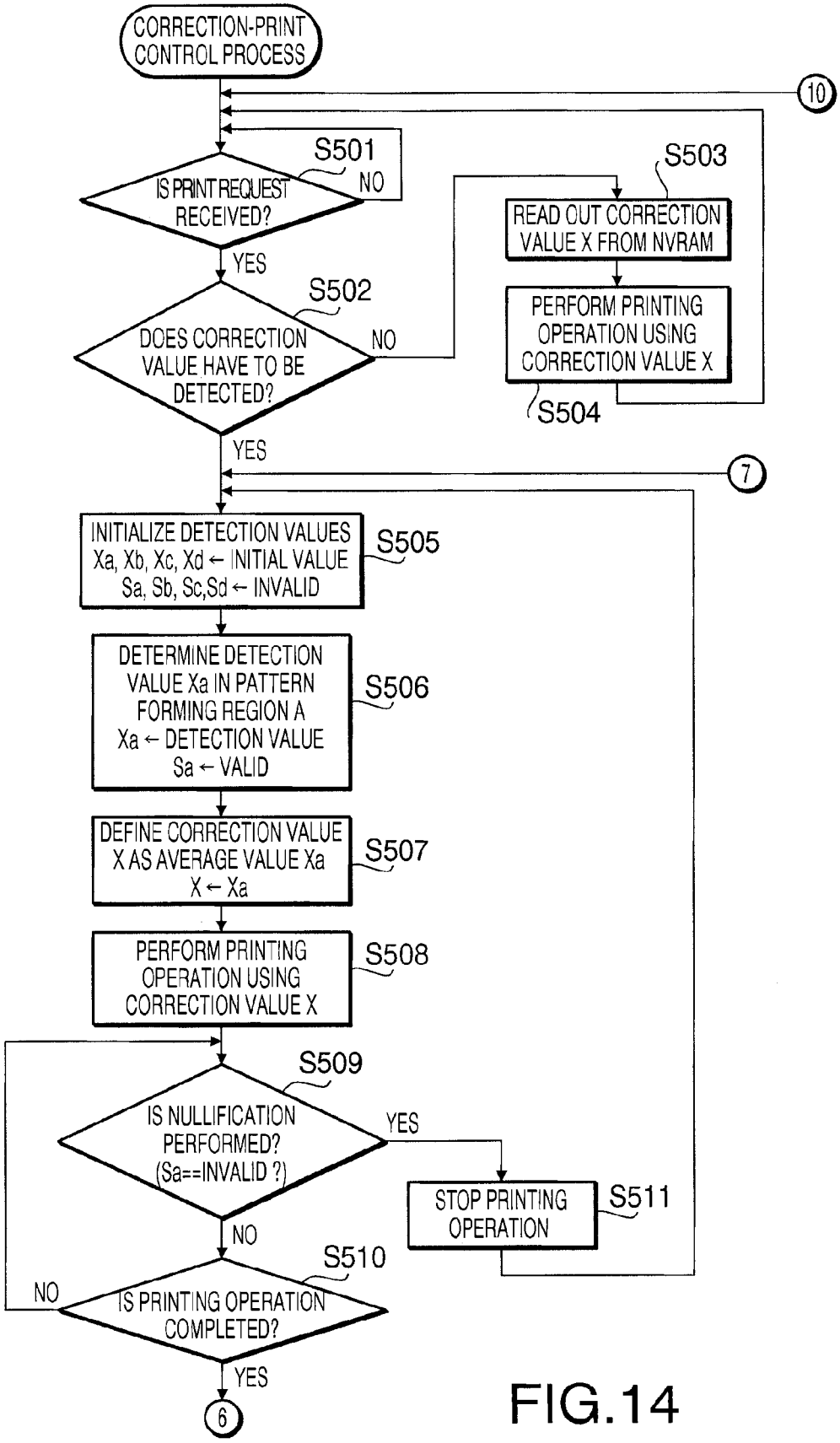
FIGS. 14 to 17 are flowcharts showing a procedure of a correction-print control process in the fourth embodiment according to one or more aspects of the present invention.

FIGS. 14 to 17 are a flowchart showing a procedure of a correction-print control process. When the correction-print control process is launched, as illustrated in FIG. 14, the CPU 40 first waits for a print request to be received (S501). When a print request is received (S501: Yes), the CPU 40 next determines whether to detect a correction value for the positional deviation correction (S502). Then, when it is determined that a correction value does not have to be detected (S502: No), such as when the correction request flag is set off, a correction value stored on the NVRAM 43 is read out (S503). Then, a printing operation is performed using the correction value (S504). Thereafter, the present process goes back to S501, in which the CPU 40 waits for a print request to be received.

In addition, when it is determined that a correction value has to be detected (S502: Yes), the CPU 40 sets an initial value (a value representing an undetected state) for each of the detection values Xa to Xd in the pattern forming regions A to D, and also sets each of the validity flags Sa to Sd to an invalid state (S505). Subsequently, the pattern P is formed in the pattern forming region A to acquire a detection value, and the acquired value is defined as the detection value Xa, and the validity flag Sa corresponding to the detection value Xa is set to be valid (S506). Then, the detection value Xa is stored on the RAM 42 as a correction value X employed for a printing operation (S507).

Subsequently, the CPU 40 begins a printing operation in response to the print request with the correction value X (S508). Then, the CPU 40 determines whether nullification in S403 of the nullification process has been performed, namely, whether the validity flag Sa is invalid (S509). When it is determined that the nullification has not been performed (S509: No), the CPU 40 determines whether the printing operation is completed (S510). When it is determined that the printing operation is in execution (S510: No), the present process goes back to S509. When the nullification has been performed prior to completion of the printing operation (S509: Yes), the printing operation in execution is stopped (S511). Then, the present process goes back to S505 to again perform the correcting operation (S506 and S507) based upon the pattern P in the pattern forming region A and the printing operation.

Figure 15:
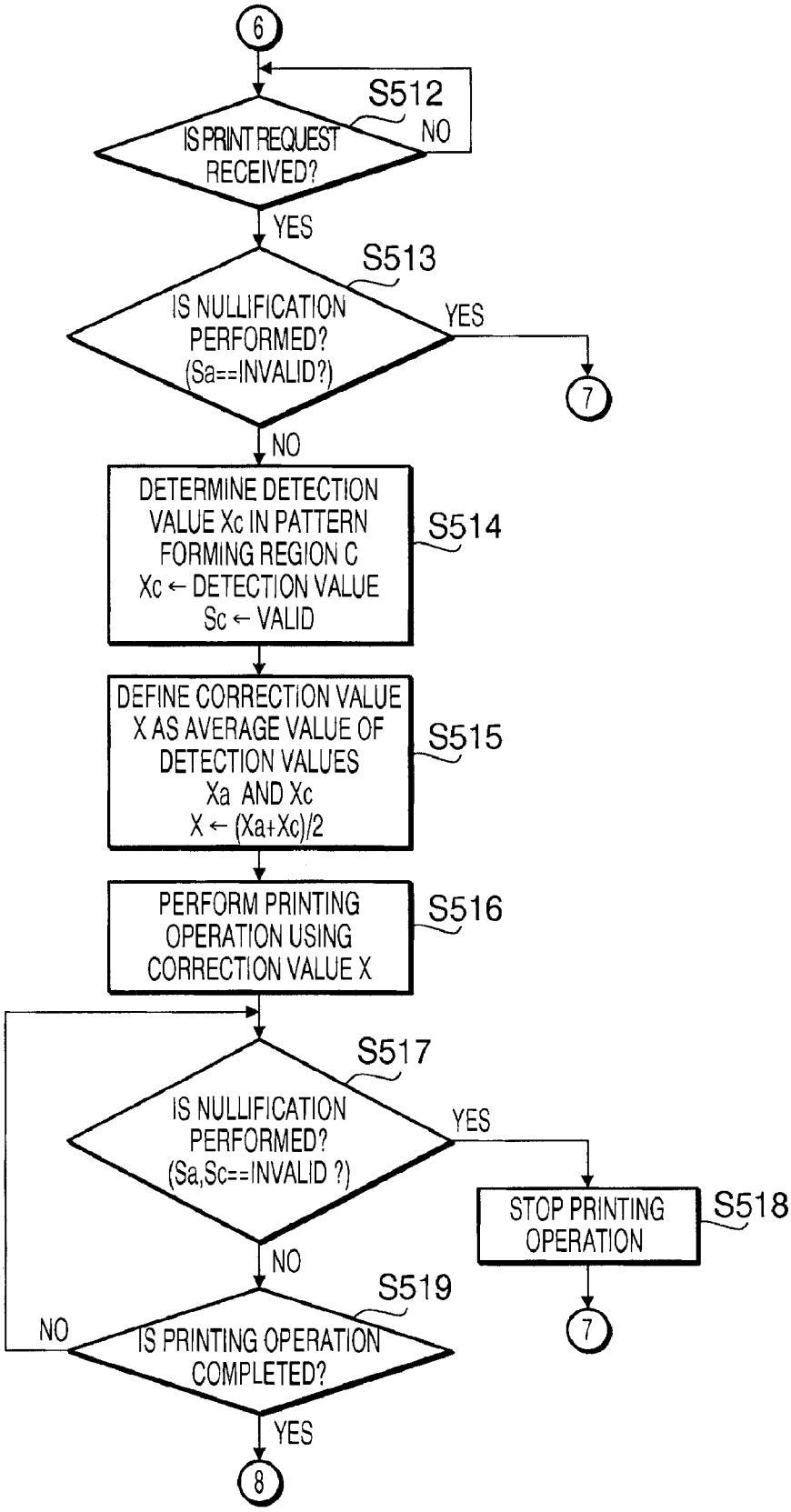

When the printing operation is completed (S510: Yes), as shown in FIG. 15, the CPU 40 waits for a print request to be received (S512). When a print request is received (S512: Yes), the CPU 40 determines whether the nullification in S403 of the nullification process has been performed, namely, whether the validity flag Sa is invalid (S513). When it is determined that the nullification has been performed (S513: Yes), the present process goes back to S505, and the correcting operation based upon the pattern P in the pattern forming region A is executed again.

When it is determined that the nullification has not been performed (S513: No), a correcting operation is performed, in the same manner, based upon the pattern P in the pattern forming region C to acquire a detection value Xc, and the validity flag Sc corresponding to the detection value Xc is set to be valid (S514). Then, a correction value X is determined as an average value of the detection values Xa and Xc (S515). Subsequently, a printing operation in response to the print request is executed (S516). Then, it is monitored whether the nullification has been performed in execution of the printing operation, namely, whether the validity flags Sa and Sc are invalid (S517). When it is determined that the nullification has been performed (S517: Yes), the printing operation in execution is stopped (S518), and the present process goes back to S505.

Figure 16:
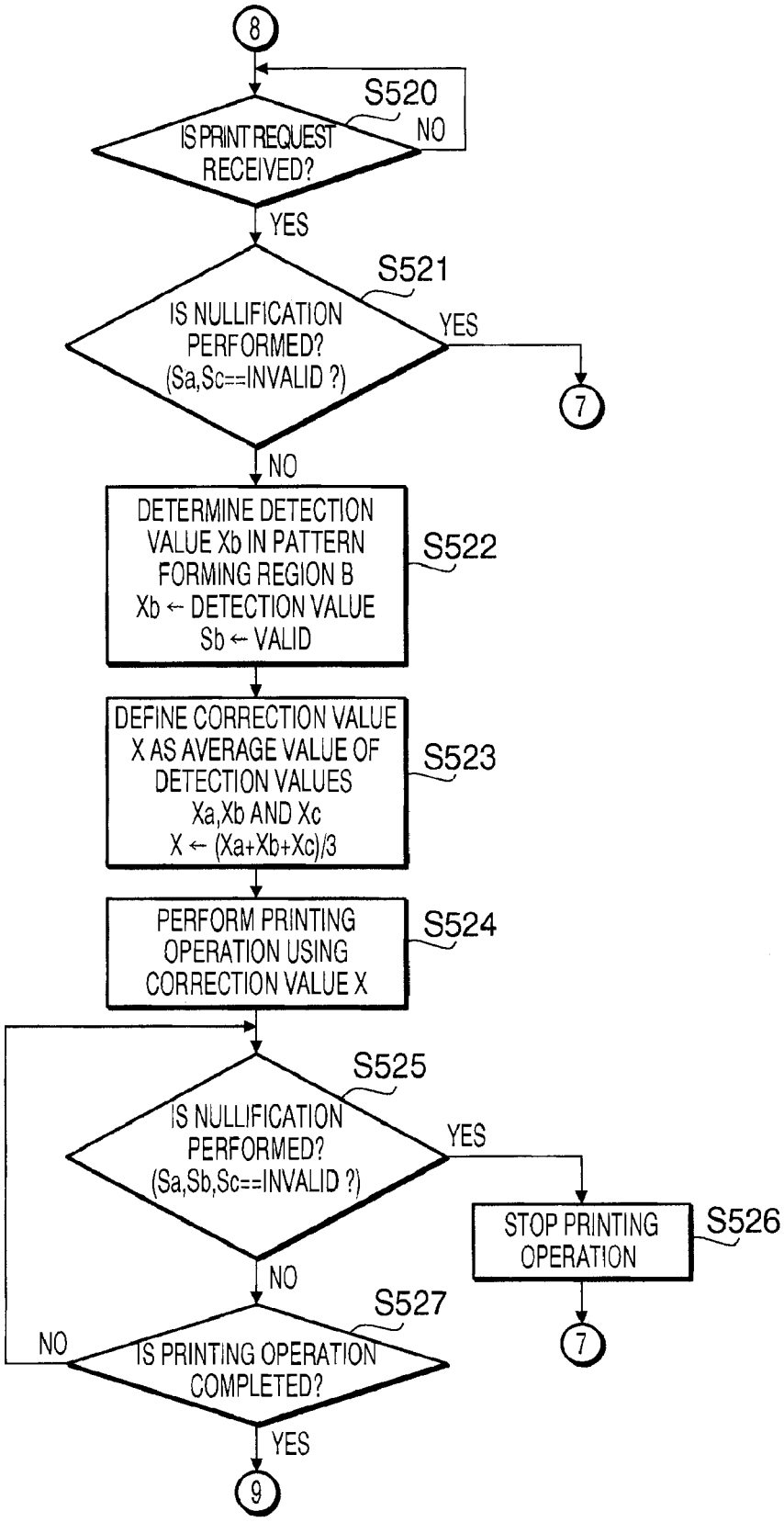

In addition, when the printing operation is completed (S519: Yes), as shown in FIG. 16, the CPU 40 waits for a print request to be received (S520). When a print request is received (S520: Yes), the CPU 40 determines whether the nullification has been performed, namely, whether the validity flags Sa and Sc are invalid (S521). When it is determined that the nullification has been performed (S521: Yes), the present process goes back to S505. Meanwhile, when it is determined that the nullification has not been performed (S521: No), a correcting operation is performed based upon the pattern P in the pattern forming region B to acquire a detection value Xb, and the validity flag Sb corresponding to the detection value Xb is set to be valid (S522). Then, a correction value X is determined as an average value of the detection values Xa, Xb, and Xc (S523). Subsequently, a printing operation in response to the print request is executed using the correction value X (S524). Then, it is monitored whether the nullification has been performed in execution of the printing operation, namely, whether the validity flags Sa, Sb, and Sc are invalid (S525). When it is determined that the nullification has been performed (S525: Yes), the printing operation is stopped (S526), and the present process goes back to S505.

Figure 17:
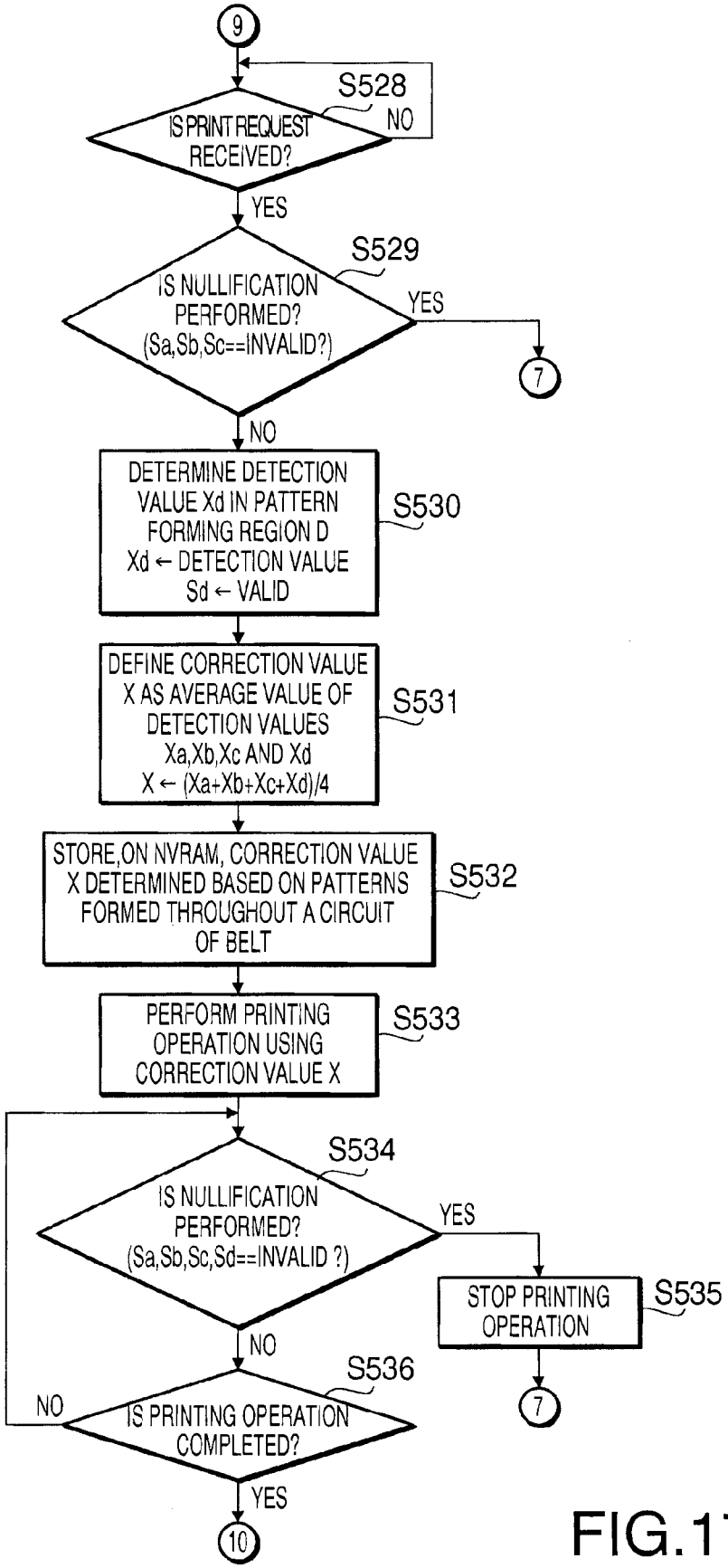

Meanwhile, when it is determined that the nullification has not been performed (S525: No), the CPU 40 determines whether the printing operation is completed (S527). When it is determined that the printing operation is completed (S527: Yes), as illustrated in FIG. 17, the CPU 40 waits for a print request to be received (S528). When a print request is received (S528: Yes), the CPU 40 determines whether the nullification has been performed, namely, whether the validity flags Sa, Sb, and Sc are invalid (S529). When it is determined that the nullification has been performed (S529: Yes), the present process goes back to S505. Meanwhile, when it is determined that the nullification has not been performed (S529: No), a correcting operation is performed based upon the pattern P formed in the pattern forming region D to acquire a detection value Xd, and the validity flag Sd corresponding to the detection value Xd is set to be valid (S530). Then, a correction value X is determined as an average value of the detection values Xa, Xb, Xc, and Xd (S531). Thereafter, the correction value X determined based upon the patterns P formed throughout a circuit of the belt 13 is stored on the NVRAM 43 (S532). Subsequently, a printing operation in response to the print request is performed using the correction value X (S533). After that, the CPU 40 determines whether the nullification has been performed in execution of the printing operation, namely, whether the validity flags Sa to Sd are invalid (S534). When it is determined that the nullification has been performed in execution of the printing operation (S534: No), the printing operation is stopped (S535), and the present process goes back to S505. Meanwhile, when it is determined that the nullification has not been performed (S534: No), the CPU 40 determines whether the printing operation is completed (S536). When the printing operation is in execution (S536: No), the present process goes to S534. Meanwhile, when the printing operation is completed (S536: Yes), the present process goes back to S501.

Figure 18:
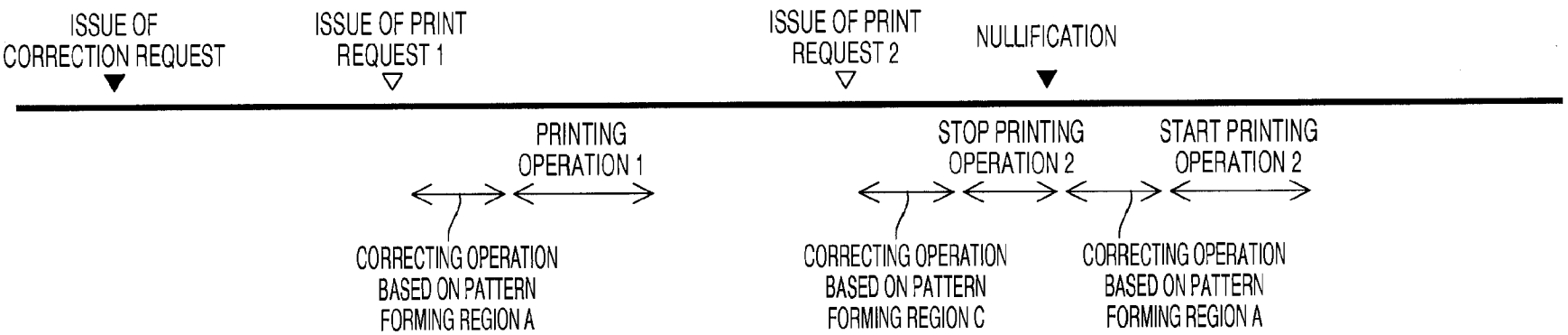
FIG. 18 is a schematic diagram exemplifying an execution timing of each operation in the correction-print control process in the fourth embodiment according to one or more aspects of the present invention.

FIG. 18 is a schematic diagram exemplifying an execution timing of each operation in the correction-print control process. As shown in FIG. 18, when a print request 1 is received in a state where the correction request flag is set on, the CPU 40 first performs a correcting operation based upon the pattern P in the pattern forming region A (S506 and S507 in FIG. 14). Next, a printing operation in response to the print request 1 is launched (S508). After completion of the printing operation in response to the print request 1, when a print request 2 is received, a correcting operation is performed based upon the pattern P in the pattern forming region C (S514 and S515 in FIG. 1). Subsequently, a printing operation in response to the print request 2 is started (S516).

When the nullification is carried out, for a reason such as a paper jam, in execution of the printing operation in response to the print request 2 (S403 in FIG. 13), the printing operation is stopped (S518 in FIG. 15). Then, the correcting operation based upon the pattern P in the pattern forming region A is performed again (S506 and S507 in FIG. 14). Thereafter, the printing operation in response to the print request 2 is executed (S508).

As described above, according to the fourth embodiment, when such a situation is caused that reliability of a previous detection result cannot be maintained, such as when a paper jam is caused, it is possible to detect the above situation and avoid low-accuracy correction based upon the previous detection result.

Fifth Embodiment

Figure 19:
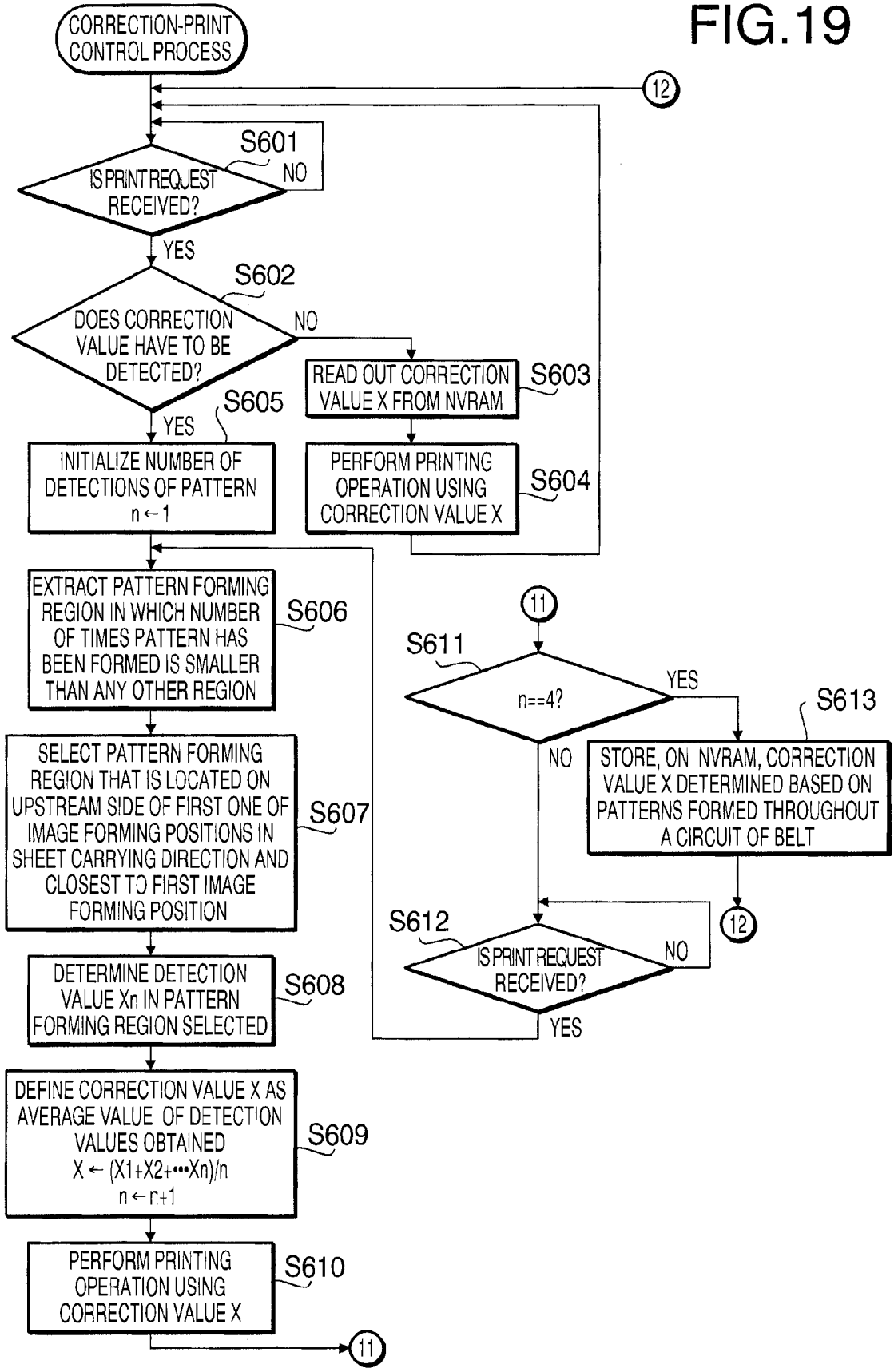
FIG. 19 is a flowchart showing a procedure of a correction-print control process in a fifth embodiment according to one or more aspects of the present invention.

Next, a fifth embodiment according to aspects of the present invention will be described with reference to FIG. 19. FIG. 19 is a flowchart showing a procedure of a correction-print control process in the fifth embodiment.

When the correction-print control process is launched, as illustrated in FIG. 19, the CPU 40 first waits for a print request to be received (S601). When a print request is received (S601: Yes), the CPU 40 determines whether to detect a correction value for the positional deviation correction (S602). When it is determined that a correction value does not have to be detected (S602: No), such as when the correction request flag is set off, a correction value X stored on the NVRAM 43 is read out (S603), and a printing operation in response to the print request is performed using the correction value X (S604). Thereafter, the present process goes back to S601, in which the CPU 40 waits for a print request to be received.

Meanwhile, when it is determined that a correction value has to be detected (S602: Yes), the number n of detections of the pattern P in correcting operations, which is stored on the RAM 42, is set to 1 (S605). Then, a pattern forming region, in which the number of times the pattern P has been formed in past correction operations is smaller than that in any other region, is extracted from the pattern forming regions A to D (S606). It is noted that the NVRAM 43 stores thereon the number of times the pattern P has been formed in each of the pattern forming regions A to D in past correcting operations, and the CPU 40 extracts a pattern forming region of the smallest number of formations of the pattern P with reference to data stored on the NVRAM 43.

When the extracted pattern forming region includes a plurality of regions, the CPU 40 selects, from the plurality of extracted regions, a pattern forming region that is located on an upstream side of a first one of image forming positions in the sheet carrying direction and the closest to the first image forming position on the basis of a current position of the belt 13 (S607). Meanwhile, when the extracted pattern forming region includes only a single region, the CPU 40 selects the single extracted region.

Subsequently, the pattern P is formed in the pattern forming region selected, and a detection value Xn is acquired based upon the pattern P in the selected region (S608). Then, a calculation is made to determine, as a correction value X, an average value of the detection value Xn acquired and detection values X1 to X(n−1) ever obtained, and the number of detection times n is incremented by one (S609). Thereafter, a printing operation in response to the print request is performed using the correction value X (S610).

Subsequently, the CPU 40 examines whether the number of detection times n is 4, namely, whether the correcting operation has been performed based upon the patterns P formed throughout a circuit of the belt 13 (S611). When the number of detection times n is less than 4, the CPU 40 waits for a print request to be received (S612). Then, when a print request is received (S612: Yes), the present process goes back to S606, and a correcting operation is executed (S606 to S609). Meanwhile, when the number of detection times n reaches 4 (S611: Yes), the correction value X determined based upon the four patterns P formed throughout a circuit of the belt 13 is stored on the NVRAM 43 (S613). After that, the present process goes back to S601.

In the fifth embodiment, in the same manner as shown in FIG. 6, when the correction request flag is set on, a single correcting operation is performed each time a print request is received, and followed by a printing operation. Since each correcting operation is performed based upon the pattern P one fourth as long as a circuit of the belt 13, it needs a shorter time than a time taken for measurement of the patterns P formed throughout a circuit of the belt 13. Further, the second correcting operation or a later-executed correcting operation is performed using detection results of the present correcting operation and one or more previous correcting operations, and therefore it is possible to improve the correction accuracy.

Further, according to the fifth embodiment, the pattern P is formed preferentially in a region in which the number of past formations of the pattern P is smaller than that in any other region. Hence, it is possible to effectively restrain an influence of periodic variation of the detection values accompanying the revolution of the belt 13. Additionally, since a position where the pattern P is formed is not concentrated into a specific region, it can be avoided that a specific position on the belt 13 is stained or damaged in a concentrated manner.

Further, according to the fifth embodiment, a pattern forming region located the closest to the first one of the image forming positions is selected from a plurality of pattern forming regions extracted, and the pattern P is formed in the selected region. Thus, it is possible to reduce a time period taken for formation of the pattern P on the belt 13 and thereby a time period taken for the correcting operation.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

(Modifications)

(1) The number, interval, or shape of the marks included in the pattern P for the positional deviation correction may be changed accordingly. Further, in the aforementioned embodiments, a pattern for measuring a positional deviation of an image forming position in the sheet carrying direction (an auxiliary scanning direction) has been exemplified. However, according to aspects of the present invention, a pattern for measuring a positional deviation of an image forming position in a main scanning direction may be employed.

(2) The aforementioned embodiments are adopted to carry out the positional deviation correction. However, according to aspects of the present invention, a pattern for color density correction may be formed on an object body such as the belt 13, and a density of the pattern may be detected to correct color density in an image forming operation. Even in this case, it is possible to shorten a processing time by reducing the number of detections in each single correcting operation. Further, it is possible to secure correction accuracy by performing a correcting operation based upon detection results of a correcting operation in execution and one or more previous correcting operations.

(3) In the aforementioned embodiments, a circumferential surface on the belt 13 is sectioned into four regions, and each of the regions is defined as a pattern forming region. However, the number of the pattern forming regions on an object may be changed accordingly. In addition, each pattern forming region may overlap mutually.

(4) Furthermore, a plurality of modes may be provided for a correcting operation, and the plurality of modes may include a detailed mode in which the correcting operation is performed based upon patterns formed throughout a circuit of a circumferential surface of a carrying body such as the belt 13 and a simplified mode in which the correcting operation is performed based upon one or more patterns within a range shorter than a circuit of the circumferential surface of the carrying body. In this case, the correcting operation may be performed in a mode selected from the above two modes depending on a situation.

(5) In the aforementioned embodiments, the belt 13 is exemplified as an object on which a pattern is formed. However, according to aspects of the present invention, in an image forming device using a transfer drum, a pattern may be formed on the transfer dram. Further, a pattern may be formed on a recording medium such as a sheet.

(6) In the aforementioned embodiments, a single printing operation is performed in response to a single print request. However, according to aspects of the present invention, a single printing operation may be performed every a predetermined number of printed pages. In this case, instead of repeating a single correcting operation and a single printing operation in response to a single print request as shown in FIG. 12, a single correcting operation and a printing operation for the predetermined number of printed pages may be repeated.

What is claimed is:

1. An image forming device, comprising:

an image forming unit including a sheet carrying body and an image transfer unit configured to form the image on the sheet carrying body;

a detection unit configured to detect a correction pattern formed on the sheet carrying body;

a storage unit configured to store a result of detection by the detection unit; and a correcting unit configured to cause the image forming unit to form the correction pattern and configured to perform a correction process for correcting an offset of a position where the image is formed by the image forming unit by detecting the correction pattern with the detection unit, wherein the correcting unit divides a peripheral surface of the sheet carrying body into a plurality of regions in a circumferential direction, causes the image forming unit to form a correction pattern on a first region of the plurality of regions, the first region being different from a second region of the plurality of regions, on which a correction pattern has been formed in a previous correction process, and corrects in the correction process an offset of a position where an image is formed by the image forming unit, based on a detection result obtained by detecting the correction pattern formed on the first region and a detection result obtained by detecting the correction pattern which has been formed on the second region in the previous correction process.

2. The image forming device according to claim 1, wherein the correcting unit determines the correction pattern based on the detection result obtained, when there is no correction pattern stored in the storage unit based on a previous correction process.

3. The image forming device according to claim 1, further comprising a nullification unit configured to nullify the correction pattern formed in the previous correction process when a predetermined condition is satisfied.

4. The image forming device according to claim 3, further comprising a status change detecting unit configured to detect a predetermined status change of the image forming device, wherein the nullification unit nullifies the correction pattern formed in the previous correction process when the predetermined status change of the image forming device is detected by the status change detecting unit.

5. The image forming device according to claim 1, wherein the sheet carrying body is configured to carry a sheet thereon in a predetermined direction, and wherein the first region is shorter than a circumferential length of the sheet carrying body.

6. The image forming device according to claim 5, wherein the first region includes a region shifted in a circumferential direction of the sheet carrying body from the second region, in which the correction pattern has been formed to determine the offset of the position where the image is formed by the image forming unit on the circumferential surface of the sheet carrying body.

7. The image forming device according to claim 6, wherein the first region includes a region shifted in the circumferential direction of the sheet carrying body from the second region so as to prevent the region from overlapping the second region.

8. The image forming device according to claim 5, wherein the first region includes a region in which a numerical number of times the correction pattern has been formed is smaller than that in any other region.

9. A method, comprising:

detecting a correction pattern formed on a sheet carrying body of an image forming unit in an image forming device;

storing, in a storage unit of the image forming device, a detection result from the detecting;

causing the image forming unit to form the correction pattern;

performing a correction process for correcting an offset of a position where the image is formed by the image forming unit on the sheet carrying body by detecting the correction pattern;

dividing a peripheral surface of the sheet carrying body into a plurality of regions in a circumferential direction;

causing the image forming unit to form a correction pattern on a first region of the plurality of regions, the first region being different from a second region of the plurality of regions, on which a correction pattern has been formed in a previous correction process; and correcting in the correction process an offset of a position where an image is formed by the image forming unit, based on a detection result obtained by detecting the correction pattern formed on the first region and a detection result obtained by detecting the correction pattern which has been formed on the second region in the previous correction process.

10. The method according to claim 9, wherein the first region is shorter than a circumferential length of the sheet carrying body.

11. A non-transitory computer readable medium having computer executable instructions stored thereon, the instructions causing an image forming device, which includes a storage unit, to perform:

a correction value determining step of determining a correction value for correcting the image forming property with the first detection value stored on the storage unit in the storing step and a second detection value that has previously stored on the storage unit; and detecting a correction pattern formed on a sheet carrying body of an image forming unit in an image forming device;

storing, in a storage unit of the image forming device, a detection result from the detecting;

causing the image forming unit to form the correction pattern;

performing a correction process for correcting an offset of a position where the image is formed by the image forming unit on the sheet carrying body by detecting the correction pattern;

dividing a peripheral surface of the sheet carrying body into a plurality of regions in a circumferential direction;

causing the image forming unit to form a correction pattern on a first region of the plurality of regions, the first region being different from a second region of the plurality of regions, on which a correction pattern has been formed in a previous correction process; and correcting in the correction process an offset of a position where an image is formed by the image forming unit, based on a detection result obtained by detecting the correction pattern formed on the first region and a detection result obtained by detecting the correction pattern which has been formed on the second region in the previous correction process.

12. The non-transitory computer readable medium according to claim 11, wherein the first region is shorter than a circumferential length of the sheet carrying body.

* * * * *